US010143915B2

(12) United States Patent
Rice

(10) Patent No.: US 10,143,915 B2
(45) Date of Patent: Dec. 4, 2018

(54) DART GAME DIDDLE AND HANDICAP ALTERNATIVE

(71) Applicant: Arachnid 360, LLC, Loves Park, IL (US)

(72) Inventor: Patrick G. Rice, Brodhead, WI (US)

(73) Assignee: Arachnid 360, LLC, Loves Park, IL (US)

( * ) Notice: Subject to any disclaimer, the term of this patent is extended or adjusted under 35 U.S.C. 154(b) by 0 days.

(21) Appl. No.: 15/819,790

(22) Filed: Nov. 21, 2017

(65) Prior Publication Data

US 2018/0169515 A1 Jun. 21, 2018

Related U.S. Application Data

(60) Provisional application No. 62/424,935, filed on Nov. 21, 2016.

(51) Int. Cl.

| | |
|---|---|
| ***A63F 9/24*** | (2006.01) |
| ***F41J 3/00*** | (2006.01) |
| ***F41J 3/02*** | (2006.01) |
| ***A63B 65/02*** | (2006.01) |
| ***F41J 5/04*** | (2006.01) |
| ***F41J 5/052*** | (2006.01) |
| ***F41J 5/14*** | (2006.01) |

(52) U.S. Cl.

CPC ..... *A63F 9/24* (2013.01); *A63B 65/02* (2013.01); *F41J 3/0023* (2013.01); *F41J 3/0028* (2013.01); *F41J 3/0066* (2013.01); *F41J 3/02* (2013.01); *F41J 5/04* (2013.01); *F41J 5/052* (2013.01); *F41J 5/14* (2013.01)

(58) Field of Classification Search

None

See application file for complete search history.

(56) References Cited

U.S. PATENT DOCUMENTS

| | | | |
|---|---|---|---|
| 4,057,251 | A | 11/1977 | Jones et al. |
| 4,516,781 | A | 5/1985 | DeVale et al. |
| 4,793,618 | A | 12/1988 | Tillery et al. |
| 4,881,744 | A | 11/1989 | Hansen |
| 4,974,857 | A | 12/1990 | Beall et al. |
| 5,020,806 | A | 6/1991 | Martin |

(Continued)

FOREIGN PATENT DOCUMENTS

WO WO 1998/031980 A1 7/1998

OTHER PUBLICATIONS

International Patent Application No. PCT/US2017/062826, International Search Report (dated Mar. 9, 2018).

*Primary Examiner* — Ronald Laneau

(74) *Attorney, Agent, or Firm* — Leydig, Voit & Mayer, Ltd.

(57) ABSTRACT

A multiple target electronic dart gaming machine includes multiple targets mounted on opposite sides of a game board of a target assembly that is housed in a cabinet of the gaming machine. A visual display video monitor provides players and observers with game scores and the like. The game board may be axially rotated between at least first and second positions so as to allow game play on the different targets which can be moved into and out of position to aid in gameplay such as deciding which player goes first. Additionally, the position of the game board may be detected through the use of a detector on or in the board.

20 Claims, 18 Drawing Sheets

(56) References Cited

U.S. PATENT DOCUMENTS

| | | | | |
|---|---|---|---|---|
| 5,116,063 | A | 5/1992 | Harlan et al. | |
| 5,366,230 | A | 11/1994 | Sanquinetti-Trigo | |
| 5,401,033 | A | 3/1995 | Lychock, Jr. | |
| 5,553,861 | A | 9/1996 | Pan | |
| 5,593,349 | A | 1/1997 | Miguel et al. | |
| 6,076,021 | A | 6/2000 | Houriet, Jr. et al. | |
| 7,361,083 | B2 * | 4/2008 | Valero Moreno | G07F 17/32 273/371 |
| 7,402,793 | B2 | 7/2008 | Martin et al. | |
| 7,416,489 | B2 | 8/2008 | Smith, III | |
| 7,487,971 | B2 * | 2/2009 | Angles | F41J 1/10 273/407 |
| 7,866,668 | B2 * | 1/2011 | Huang | F41J 5/052 273/376 |
| 8,403,672 | B2 * | 3/2013 | Odorisio | F41J 5/044 434/12 |
| 9,739,575 | B2 * | 8/2017 | Hong | F41J 3/0028 |
| 9,975,050 | B1 * | 5/2018 | Pieron | A63F 13/12 |
| 9,997,007 | B2 * | 6/2018 | Acres | G07F 17/3202 |
| 2005/0006847 | A1 * | 1/2005 | Ross | F41J 5/22 273/374 |
| 2008/0012232 | A1 | 1/2008 | Caspi et al. | |
| 2009/0218769 | A1 * | 9/2009 | Krzewicki | A63D 15/20 273/374 |
| 2012/0083342 | A1 | 4/2012 | Cross et al. | |
| 2012/0299244 | A1 * | 11/2012 | Rice | F41J 3/0028 273/407 |
| 2015/0273320 | A1 * | 10/2015 | Pieron | A63F 13/79 463/25 |

* cited by examiner

DART GAME DIDDLE AND HANDICAP ALTERNATIVE

CROSS REFERENCE TO RELATED APPLICATIONS

The instant application claims priority to U.S. Provisional Patent Application Ser. No. 62/424,935, which was filed on Nov. 21, 2016, and which is incorporated herein in its entirety by this reference.

FIELD OF THE DISCLOSURE

The present invention relates generally to pay-for-play, self-scoring electronic dart games and, more particularly, to an electronic dart game having multiple play surfaces or targets.

BACKGROUND OF THE INVENTION

Self-scoring, electronic, single target dart games typically remove the score keeping burden from players during game play so the majority of their attention can be directed to actual game play strategy, accomplishments, comradery and competition. However, one aspect of the game includes determining of who goes first, which is especially complicated when players are not physically playing on the same machine or at least in the same location. Remotely located player, which may be paired to play based on their skills or at random, must slow down play during a manual, visual inspection to determine who goes first.

Dart games which disclose electronic dart boards, score detectors and game computers are shown and described in U.S. Pat. No. 4,057,251 (Jones et al.); U.S. Pat. No. 4,516,781 (DeVale et al.); U.S. Pat. No. 4,793,618 (Tillery et al.); U.S. Pat. No. 4,881,744 (Hansen); U.S. Pat. No. 4,974,857 (Beall et al.); U.S. Pat. No. 5,116,063 (Harlan et al.); and U.S. Pat. No. 5,401,033 (Lychock, Jr.). These machines, however, are not capable or set up for facilitating remote gameplay, at least with respect to selecting which player goes first.

BRIEF SUMMARY OF THE DISCLOSURE

The present invention relates to multiple target dart games utilizing axial rotation of a game board that provides the players options as to the target on the gaming machine that is to be used for game play, where a predetermined target can be required for use at specific times during competitions to automate the decision making necessary for first player advantage. Further, certain embodiments of the present invention are for use in coin-operated industry environments where dart games are adapted with an automatic fee-for-play collection mechanism. Embodiments of the present invention also provide a robust multiple target electronic dart game with axial rotation that also reduces production costs through the use of shared electrical components.

Additionally, embodiments of the present invention also provide a user friendly mechanism to allow players to move and latch into place a player selected and/or preferred target, or to do so based on computer displayed instructions indicating this requirement must be met before play continues, or, in the case of a motor allowing for this active target transitioning, to have the computerized motor controller perform the necessary positioning, as, for example, in cases where handicapping is used. Further, according to certain embodiments, the present invention provides a robust and re-enforced dual purpose latch and release mechanism optimally positioned to withstand powerful physical blows to the invention by players, such as players frustrated or overzealous with their game play, before, during and after dart removal from a target. Additionally, embodiments of the present invention provide a contactless target positioning mechanism, such as, for example, a magnetic field detector, which is optimally positioned for reliable, consistent target position detection.

One aspect of the present invention is a gaming machine having a game controller that includes a cabinet having a front portion and a back portion. The gaming machine also includes a game board that is rotatably secured to the cabinet. The game board includes a first target side, a second target side, and a detector. The first target side is configured for game play of a first game, and the second target side is configured for game play of a second game. The game board is rotatable about the cabinet between at least a first position and a second position. The first target side faces the front portion of the cabinet when the game board is in a first position, while the second target side faces the front portion when the game board is in the second position. The detector is configured for the detection of a position of the game board relative to the cabinet. Further, the game controller is configured to determine whether the game board is in the first or second position based on the position of the game board detected by the detector. The gaming machine further includes a latch mechanism that is operably connected to the game board. The latch mechanism, which includes a handle and a bolt, is configured to engage the cabinet to releasably retain the game board in a first or second position.

According to another aspect of the present invention, a gaming machine includes a target assembly secured to a cabinet. The target assembly includes a multi-sided game board, a game controller, and a magnetic field detector. The multi-sided game board is rotatable about the cabinet between at least a first position and a second position. Further, the multi-sided game board also includes at least two target sides that are configured for play of electronic dart games. The magnetic field detector is configured to detect a magnetic field generated by one or more magnets positioned in the cabinet. The game controller is configured to determine whether the multi-sided game board is in a first or second position based on the polarity of the magnetic field detected by the magnetic field detector.

A further aspect of the present invention is a gaming machine having a cabinet having a first side and a second side. The gaming machine also includes a target assembly that is secured to the cabinet. The target assembly has a multi-sided game board, a game controller, and a magnetic field detector. The multi-sided game board is rotatable about the cabinet between at least a first position and a second position. Additionally, the multi-sided game board includes at least two target sides configured for play of electronic dart games. The magnetic field detector is configured to detect a first magnetic field that is generated by a first magnet positioned in proximity to the first side of the cabinet. The magnetic field detector is also configured to detect a second magnetic field generated by a second magnet positioned in proximity to the second side of the cabinet. Further the first and second magnetic fields have a different polarity. The game controller is configured to determine whether the multi-sided game board is in a first or second position based on the polarity of the magnetic field detected by the magnetic field detector. Additionally, the game controller used for score detection for the first target side is the same game controller used for score detection for the second target side.

The problem to be solved by this new invention pertains to computerized determination of who shoots/throws first in a dart match competition. Typically, within the soft-tipped, automatic scoring, electronic dart community, determination of who goes first is made after those involved throw a dart; the closest to the center of the bullseye being selected to begin. The determination of which player goes first has heretofore been performed manually and agreed to by the players involved. Even in automatically scoring dart machines, this determination must still be performed manually or visually by the players because the membrane switch sensor resolution with associated plastic segment activation mechanism of a typical score target lacks the resolution necessary to resolve a dart present at any particular hole. This has been the case since the introduction of this automatic scoring method using a 15" target membrane switch.

A gaming machine in accordance with the present disclosure overcomes the shortcomings of the prior art and provides a system and method for automatically determining the score of the first dart thrown by players matched in a game, even if those players are using different machines located in different, locations and also for games in which all players are engaging in play at different times. In one embodiment, the machine in accordance with the disclosure temporarily switches or changes a sensor with a finer resolution than the normal play sensor, for example, by using a smaller target/membrane, thus allowing a machine controller to determine the order or play as between the players. Instead of throwing a single dart, the controller transforms the "diddle for the middle" precursor to a normal dart game into a micro-game, in which as few darts as feasible are thrown to the more sensitive target of the machine, and a best score is used for first shooter selection. In this way, a different target is first presented to the players in a first machine operating mode, either manually or automatically, and a single round game of count up (highest score) is played, and the winner is automatically assigned as the first shooter in the pending, "actual" game.

After the winner of the "diddle" round is determined, the machine is reconfigured either manually or automatically into a second mode for actual play, for example, by presenting a larger or standard dart board for the players to use. It is contemplated that, in the event of a tie during play in the first machine operating mode, the players may repeat the "diddle" round or alternate during normal play in the second machine operating mode, where the alternating is carried out automatically by the machine.

The foregoing summary, as well as the following detailed description of certain embodiments of the present invention, will be better understood when read in conjunction with the figures included. It should be understood, however, that the present invention is not limited to the arrangements and instrumentalities shown in these figures.

DETAILED DESCRIPTION OF SEVERAL VIEWS OF THE DRAWINGS

Figure 1:
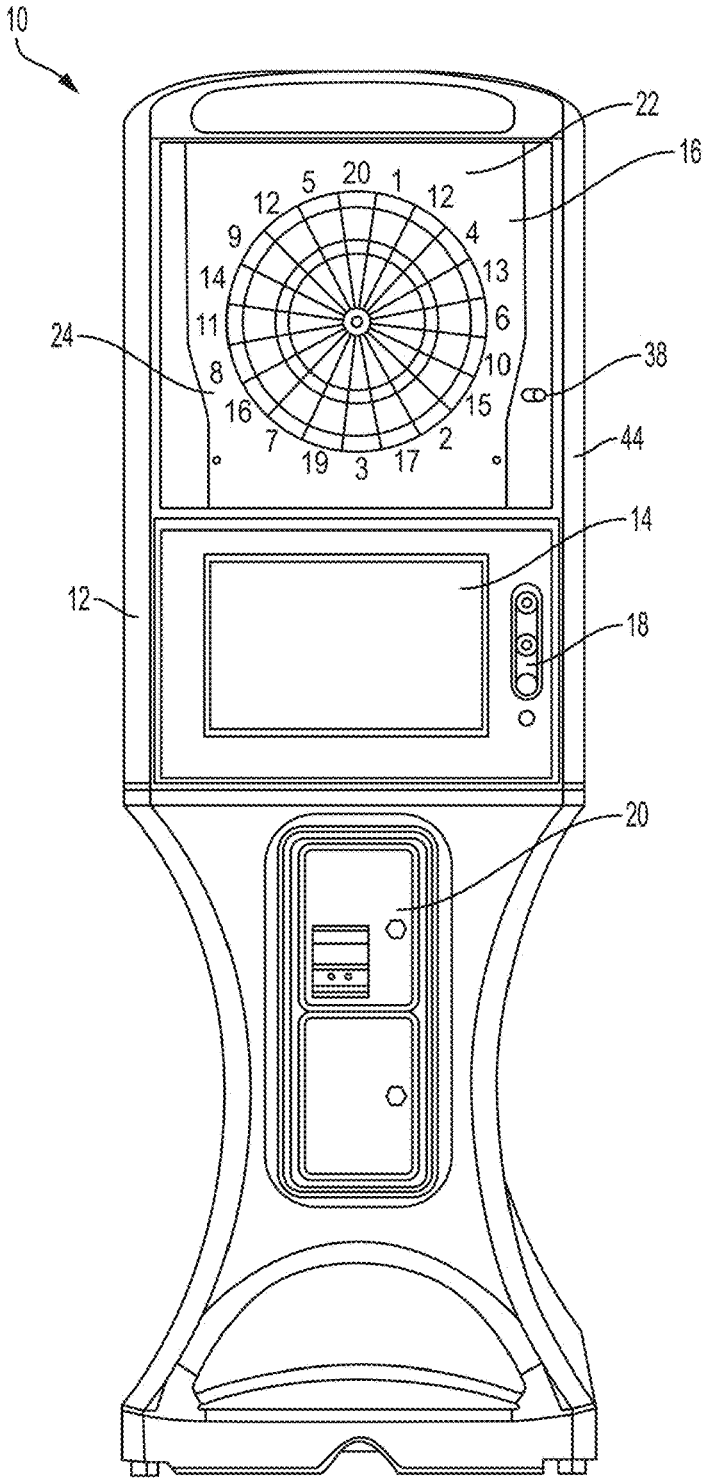
FIG. 1 illustrates a multiple target dart game according to an illustrated embodiment of the present invention.

FIG. 1 illustrates a multi-target gaming machine 10 according to an illustrated embodiment of the present invention. The multi-target gaming machine 10 includes a cabinet 12 that houses a display 14, a target assembly 16, and a main game processor. The cabinet 12 may also house or support a player input device 18, such as, for example, a plurality of buttons or switches. Alternatively, according to other embodiments, the player input device 18 may be a touch screen on the display 14. Additionally, the gaming machine 10 may also be configured for electronic scoring detection for multiple target games and/or shared scoring components as disclosed in U.S. Pat. Nos. 5,020,806 and 7,402,793 to Martin et al., which are incorporated herein h reference in their entirety.

The player input device 18 of the gaming machine 10 may be used for a variety of game play related operations, including, for example, during game selection, game start, selection of number of players for game play, and/or switching identification of current player(s) playing the game, among other functions. The main game controller may also include memory that is used to store game play information. For example, the main game controller may store information regarding different types of games for game play on the gaming machine 10. The main game controller may also be configured to control the information and/or images displayed on the display 14, such as, for example, the score of the game, the number of players, and/or an indication of the type of game being played, among other information and/or images.

The cabinet 12 may also include a payment mechanism 20 that is configured to receive payment for game play on the gaming machine 10. According to certain embodiments, the payment mechanism 20 is a pay-for-play mechanism such that the payment mechanism receives payment for games that are about to be played on the gaming machine 10 without the need for a third-party attendant. Moreover, according to certain embodiments, the player may use the player input device 18 to make selections for game play, such as the game to be played and/or the number of players playing the game before and/or after inserting payment into the payment mechanism 20. The payment mechanism 20 may be operably connected to the main game controller of the gaming machine 10 such that the main game controller receives an indication of when payment for game play has been inputted into the payment mechanism 20. According to certain embodiments, the payment mechanism 20 may also be configured to indicate the type, amount, and/or denomination of the currency inserted into the payment mechanism 20. Additionally, according to certain embodiments, the main game controller may be configured to determine whether the payment received by the payment mechanism 20 is sufficient for the requested game play.

According to illustrated embodiments, the target assembly 16 includes a multi-sided game board 22. For example, referencing FIGS. 1 and 2, the game board 22 has a first target side 24 and a second target side 26 on opposite sides of the game board 22. According to certain embodiments, at least a portion of the first and second target sides 24, 26 may provide a playing surface used for game play. For example, according to certain embodiments, at least a portion of the first and second target sides 24, 26 may be configured for use as an electronic dart board. According to other embodiments, the first and second target sides 24, 26 may be configured to support a playing surface, such as a dart board that is hung or otherwise attached or connected to the first and second target sides 24, 26.

According to certain embodiments, the first target side 24 may have a configuration, such as indicia, for example, that is used for play of at least one game that is different than the configuration of the second target side 26. For example, in embodiments in which the gaming machine 10 is at least used for the play of a dart game(s), the indicia on the first target side 24 may provide a standard dart board, such as shown in FIG. 1, while the indicia on the second target side 26 may provide a different dart game, such as dart baseball or golf, among others.

If the player(s) desires to play a game on a target side 24, 26 of the game board 22 that is not presently positioned relative to the cabinet 12 for game play, the player may axially rotate the game board 22 until the desired target side 24, 26 is oriented for game play. For example, when game play is to commence using the first target side 24, the game board 22 may be moved (if needed) relative to the cabinet 12 such that the game board 22 is in a first position. In the illustrated embodiment, when the game board 22 is in the first position, the player may be able to simultaneously view both the display 14 and the first game target side 24, as shown in FIG. 1. When game play is to commence using the second target side 26, the orientation of the game board 22 relative to the cabinet 12 may change so that the game board 22 is in a second position. In the illustrated embodiment, with the game board 22 in the second position, the player may be able to simultaneously view both the display 14 and the second game target side 26.

Figure 2:
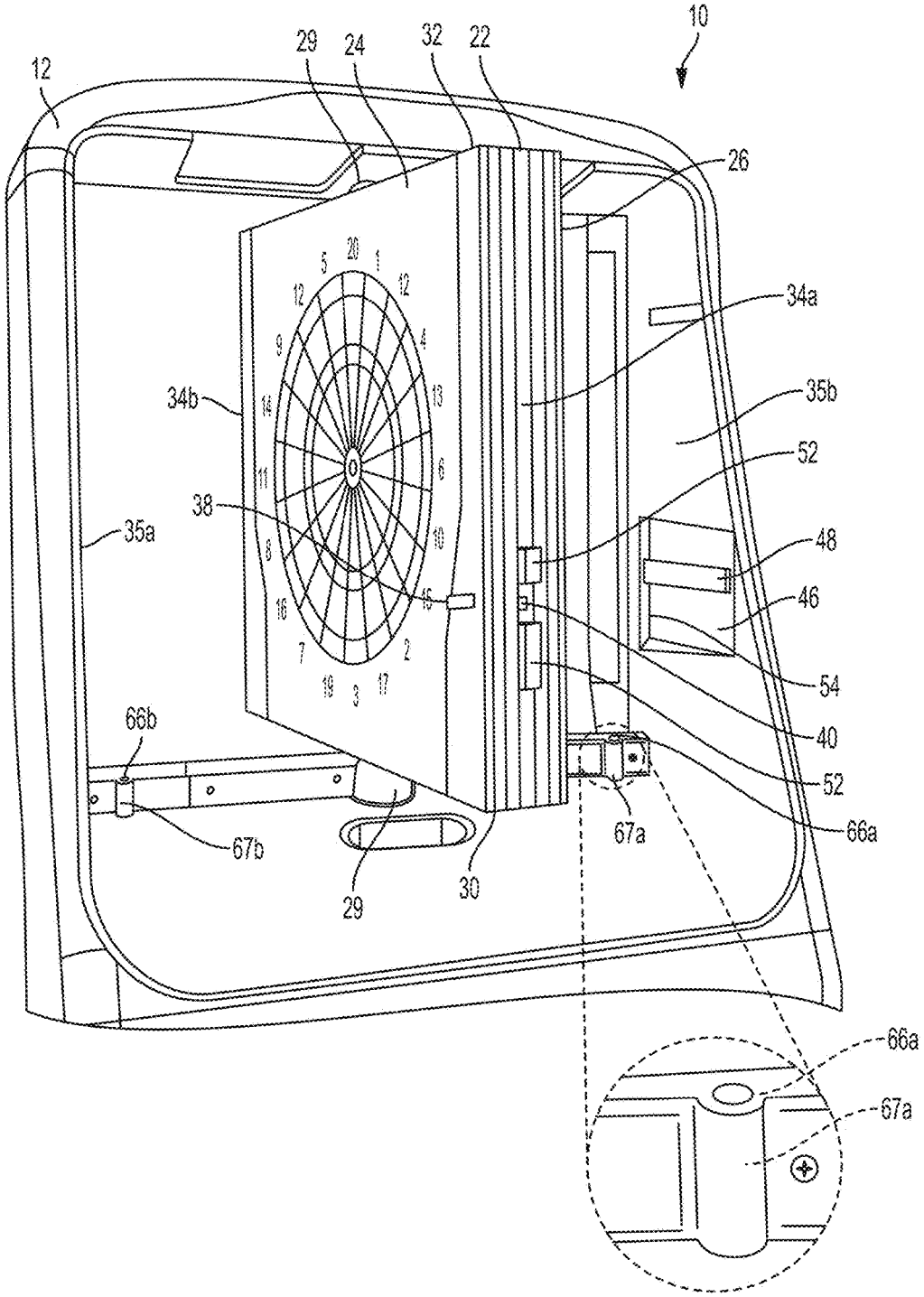
FIG. 2 illustrates a portion of a target assembly having a multi-target game board that is axially rotated between playing positions according to an illustrated embodiment of the present invention.

FIG. 2 illustrates a portion of the target assembly 16 with the game board 22 being axially rotated between playing positions, such as, for example between first and second positions. As shown, the game board 22 is operably connected to at least one shaft that is secured to the cabinet 12. Referencing FIGS. 2 and 3, according to certain embodiments, the shaft 28 may be housed in one or more bosses 29 in the cabinet 12 and is configured to be rotated when the target side 24, 26 of the game board 22 that is to be used for game play is to be changed, such as, for example, being moved from the first position to the second position, and vice versa. The shaft 28 may have a generally cylindrical configuration that allows the shaft 28 to be axially rotated in a mount or other connection or attachment in or to the cabinet 12. Alternatively, rather than the game board 22 rotating with the shaft 28, the game board 22 may be configured to be rotated about the shaft 28. The gaming machine 10 may be configured to allow the game board 22 to be rotated a full 360 degrees, or may otherwise include restrictions that limit the degree the game board 22 may be rotated, such as, for example, limiting the rotation of the game board 22 to 180 degrees.

Figure 3:
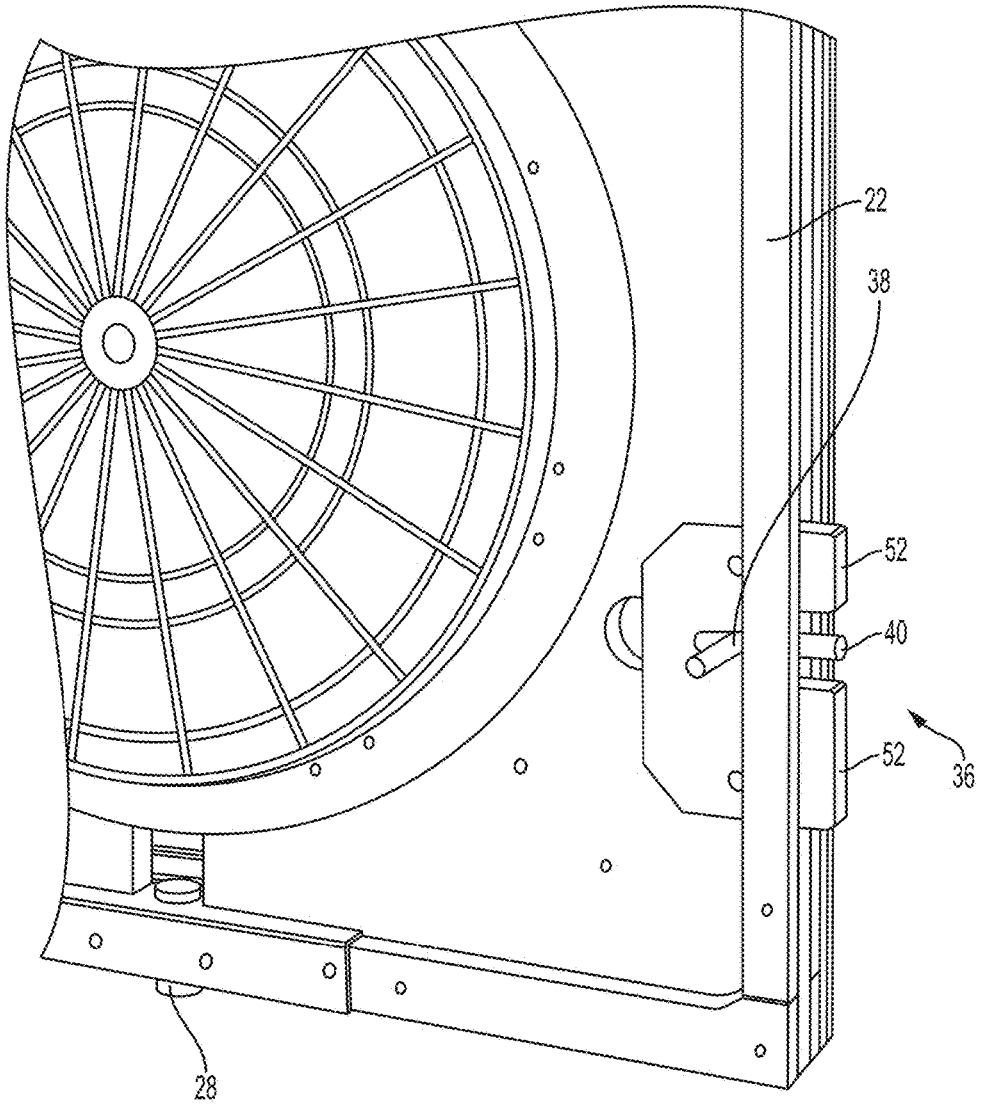
FIG. 3 illustrates a portion of a target assembly having a release or latch mechanism according to an illustrated embodiment of the present invention.

The target assembly 16 may be configured for the game board 22 to be axially rotated in any number of directions, such as along an axis that is generally perpendicular, parallel, or at an angle to the floor, or any combination thereof. For example, the shaft 28 may extend through the game board 22 so as to be operably attached to the cabinet 12 both above and below the game board 22. Alternatively, the shaft 28 may include a lower shaft and/or an upper shaft, with the lower shaft extending from the bottom 30 of the game board 22 to the cabinet 16, and the upper shaft extending from the top 32 of the game board 22 to the cabinet 12. For example, FIG. 3 illustrates a first lower shaft 28 that extends into the bottom 30 of the game board 22. According to such an embodiment, a second upper shaft 28 may extend from the top 32 of the game board 22 to the cabinet 16. Alternatively, rather than the shaft(s) 28 extending from the bottom 30 and/or top 32 of the game board 22, the shaft(s) 28 may extend from the sides 34*a*, 34*b* of the game board 22 to adjacent sides 35*a*, 35*b* in the cabinet 12.

Figure 4:
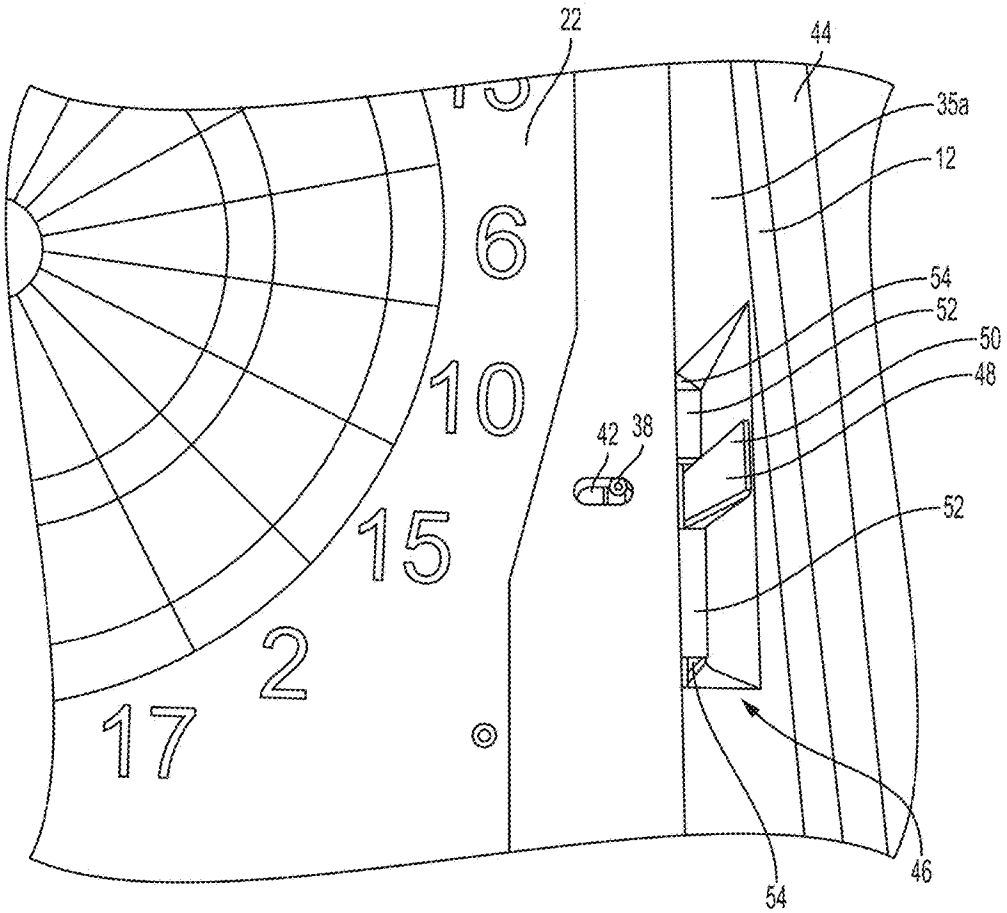
FIG. 4 illustrates a rear view of a portion of a cabinet and a target assembly for use with a gaming machine according to an illustrated embodiment of the present invention.

FIG. 3 illustrates a portion of a target assembly 16 having a release or latch mechanism 36 according to an embodiment of the present invention. The latch mechanism 36 is configured to at least assist in retaining, when desired, the game board 22 in the first or second position. According to certain embodiments, the latch mechanism 36 includes a handle 38 and a spring loaded bolt 40. The spring may be configured to bias the bolt 40 in a locked position, whereby the bolt 40 is being pushed or pulled by the spring in a direction away from the game board 22. The handle 38 may be operably connected to the bolt 40 such that the displacement of the handle 38 may be used to pull the bolt toward the game board 22 such that the bolt 40 moves from the locked position to an unlocked position. According to certain embodiments, the handle 38 may extend through an opening 42, as illustrated in FIG. 4, in both the first and second target sides 24, 26 such that the player(s) may have access to the handle from a front portion 44 of the cabinet 12 regardless if the game board 22 is in the first or second position. Alternatively, the handle 38 may consist of separate handles that each individually extend through different sides of the multi-sided game board 22. The opening 22 is configured to accommodate the displacement of the handle 38. For example, according to certain embodiments, the opening 42 may have a generally elongated configuration.

FIG. 4 illustrates a rear view of a portion of the cabinet 12 and target assembly 16. According to certain embodiments, both sides 35*a*, 35*b* of the cabinet 12 may include a recess 46 that is configured for engagement with the latch mechanism 36 so as to lock the position of the game board 22 relative to the cabinet 12. For example, the first side 35*a* of the cabinet 12 may include a recess 46 that is configured to receive a strike plate 48 that guides the bolt 40 into locking engagement with the cabinet 12. In the illustrated embodiment, the strike plate 48 may include an angled surface 50 that is configured to ensure that the bolt 40 slides into a locked position.

More specifically, as the game board 22 is being axially rotated to the first position and the user is not displacing the handle 38, the bolt 40 may be outwardly biased from the game board 22 by the spring. Therefore, when the bolt 40 initially engages the angled surface 50, the bolt 40 may be at or around its full outwardly extended locked position from the game board 22. As the game board 22 continues to be axially rotated, the angled configuration of the angled surface 50 may cause the bolt 40 to continue to be inwardly depressed into the game board 22, thereby further compressing the biasing spring of the latch mechanism 36. After the depressed bolt 40 reaches the end of the angled surface 50 of the strike plate 48 so that the angled surface 50 is no longer inwardly depressing the bolt 40, the spring is able to return the bolt 40 to its outwardly extended locked position in an area of the recess 46 behind the angled surface 50, thereby locking the position of the game board 22 relative to the cabinet 12.

Similarly, according to certain embodiments, when the game board 22 is to change positions, the user may inwardly displace the handle 38 so as to draw at least a portion of the bolt 40 toward the game board 22 so that the bolt 40 is withdrawn from the recess 46 and has sufficient clearance to pass over the angled surface 50 of the strike plate 48 The game board 22 may then be axially rotated to another position, such as being rotated from the first position to the second position. Thus, when the game board 22 in the illustrated embodiment is moved to the second position, the latch mechanism 36 may engage a similar strike plate 48 located at second side 35*b* of the cabinet 12 before the game board 22 is secured at the second position.

As shown in FIGS. 2-4, the latch mechanism 36 may also include at least one reinforcement protection block 52 positioned in proximity to the bolt 40, such as, for example, above and/or below the bolt 40. The reinforcement protection blocks 52 are configured to be received by the recess 46 in the sides 35*a*, 35*b* of the cabinet 12. Additionally, the reinforcement blocks 52 may be configured to limit the direction and degree to which the game board 22 may be rotated. For example, the reinforcement blocks 52 may extend into the recess 46 so that the reinforcement blocks 52 abut against a back wall 54 in the recess 46 that prevents the latch mechanism 36 from being rotated beyond the recess 46. Additionally, according to embodiments in which the game board 22 has two target sides, the reinforcement blocks 52 may limit the rotation of the game board 22 to 180 degrees. Further, reinforcement blocks 52 may be sized to be fitted in the recess 46 so as to provide stability to the game board 22 that limits the movement of the game board 22 when the game board is struck by a playing object, such as a dart.

Figure 5:
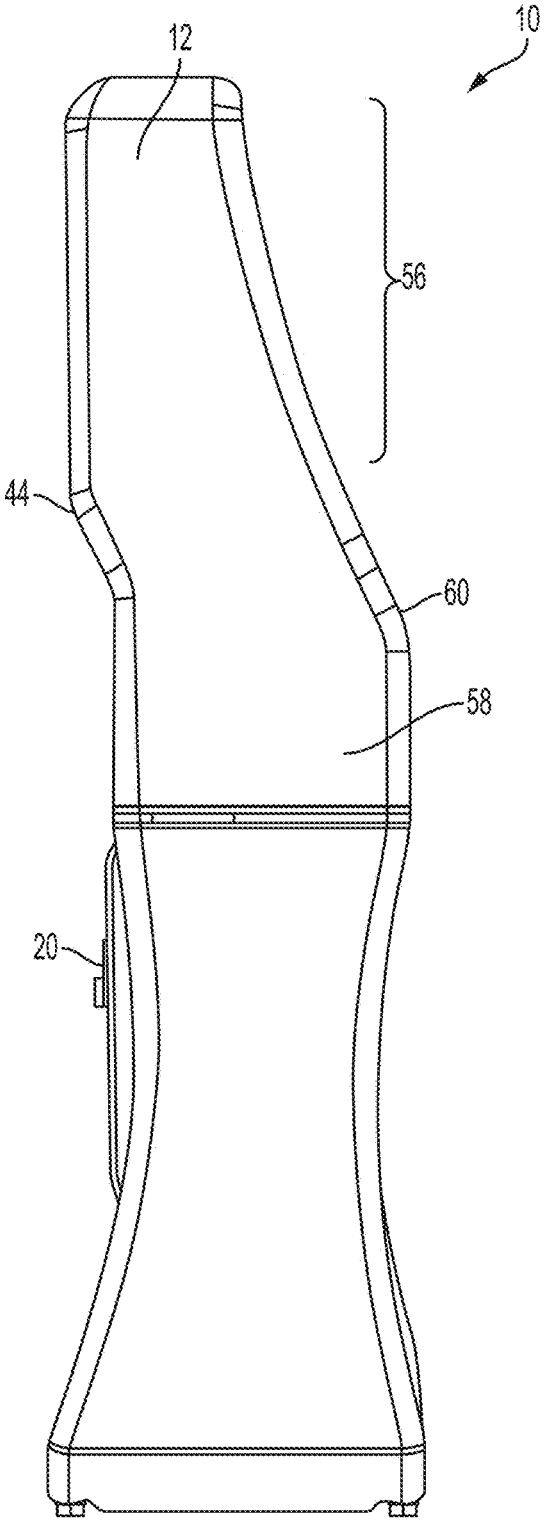
FIG. 5 illustrates a side view of a cabinet of a gaming machine that has an offset upper portion according to an illustrated embodiment of the present invention.

FIG. 5 illustrates a side view of a cabinet 12 for the gaming machine 10 according to an illustrated embodiment, As shown, according to certain embodiments, the cabinet 12 may be a floor standing unit. Additionally, the cabinet 12 may include an upper portion 56 that is positioned above a body portion 58 of the cabinet 12, The upper portion 56 of the cabinet 12 is configured to house the target assembly 16. The body portion 58 of the cabinet 12 may be have a depth sufficient to prevent interference between the game board 22 and the wall, back drop, or other surface adjacent to the back portion 60 of the cabinet 12 as the game board 22 is axially rotated, such as, for example, when the game board 22 is rotated between the first and the second positions, and vice versa. As shown in FIG. 5, in the illustrated embodiment, the back portion 60 along the upper portion 56 of the cabinet 12 may also offset from the back portion 60 along the body portion 58. This offset may further assist in preventing interference between a wall adjacent to the hack portion 60 and the game board 22 when the game board 22 is being axially rotated.

Figure 6:
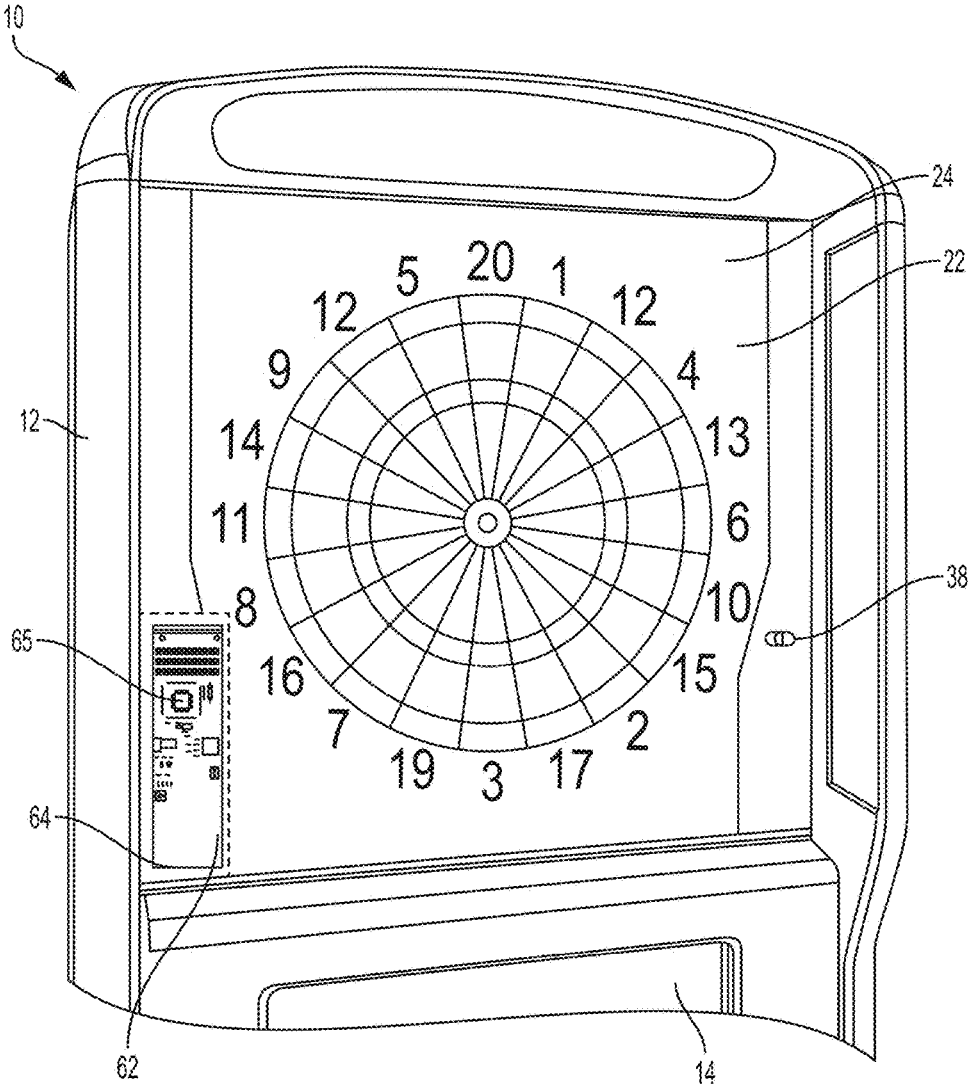
FIG. 6 is a partially cut-away view of a printed circuit board (PCB) housed in the game board of the target assembly according to an illustrated embodiment of the present invention.
Figure 7:
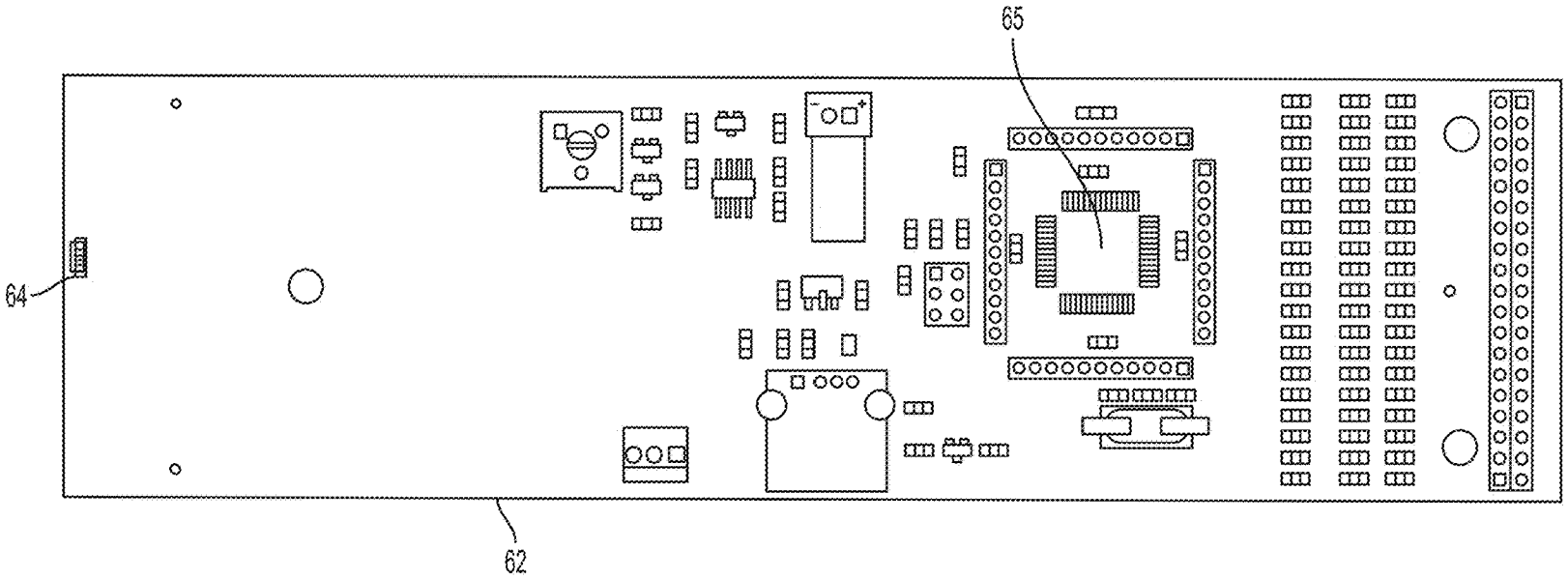
FIG. 7 is a partial PCB layout showing the location of a magnetic field detector according to an illustrated embodiment of the present invention.

The gaming machine 10 may also include a game controller involved with tracking player activity with respect to the target sides 24, 26 of the game board 22, such as, for example, the main game controller or a peripheral game controller 65. For example, FIG. 6 is a partial cutaway view illustrating a printed circuit board (PCB) 62 having a peripheral game controller 65 that is mounted inside the game board 22 of the target assembly 16. The PCB 62 and the peripheral game controller are also illustrated in FIG. 7. The peripheral game controller 65 may be involved in a variety of tasks associated with the score detection of game play objects. Examples of electronic scoring detection for multiple target games and/or shared scoring components include U.S. Pat. Nos. 5,020,806, 5,366,230, and 7,402,793, which are incorporated herein by reference in their entirety.

For example, according to embodiments in which the first and/or second target sides 24, 26 are configured to provide electronic dart game boards, the target sides 24, 26 may include a plurality of segments, such as scoring and non-scoring segments, which are positioned to provide an array of scoring locations for particular games to be played. In the customary fashion, a sensor or membrane may extend behind each segment of the game board such that impact detection information for a dart hitting that particular scoring or non-scoring segment can be provided to the game controller. This detection is communicated by an appropriate signal that is routed to the peripheral game controller 65, at which time the detection may be given a specific value or score in the context of the particular game that is in progress. In one embodiment, the score or raw signal may also be transmitted to a main game controller, where the value may be processed and applied to the current game being played. Accordingly, the peripheral game controller 65 may be used in the allocation of a score to a player(s) when the game play object is detected as having landed on and/or hits a portion of scoring target segment, such as, for example, a dart that lands on the bulls-eye of a dart board game. The peripheral game controller 65 may also be used in the determination of whether a game play object that has landed on a scoring target segment for sufficient time to be deemed a legitimate scoring event. Additionally, according to certain embodiments, the peripheral game controller 65 may perform required communications with the main game controller of the game machine 10, including transmitting and receiving as necessary all pertinent data to allow the electronic or automatic game play scoring activity to occur during game play.

In the illustrated embodiment, the peripheral game controller 65 is operably connected to a detector 64 that is used in the detection of the position of the game board 22 relative to the cabinet 12. For example, the detector 64 may be used in the detection of which target side 24, 26 is and/or is not facing the front portion 44 of the cabinet 12. Moreover, the detector 64 may provide a signal or other instruction that the peripheral game controller 65 uses to determine which target side 24, 26 is currently positioned in an orientation towards the front of the machine gameplay. Further, the detection or determination of the positioning of the game target sides 24, 26 may allow the peripheral game controller 65 to determine which target side 24, 26 is to be monitored during that period of game play for purposes of score detection. For example, if the first target side 24 is detected to be in a first, or front facing, position relative to the cabinet 12, then the peripheral game controller 65 may determine that detected scoring events during game play of the first target side 24 are to be recognized, while detected scoring or non-scoring events involving other target sides 26 are to be disregarded. According to certain embodiments, the peripheral game controller 65 may even deactivate target sides 24, 26 that the peripheral game controller 65 determines are not currently in a forward facing position. Such detection of position of the game board 22 and which target sides 24, 26 are to be monitored, ignored, and/or deactivated for purposes of game play activities allows for the same peripheral game controller 65 to be used for different games, such as games on different target sides 24, 26.

The detection of the orientation of the game board 22, such as whether the game board 22 is in the first or second position can be achieved by a variety of different ways, including passive and active determinations. For example, the positioning of the game board 22 relative to the cabinet 12 may be determined by the use of optical sensors (both reflective and interrupted beam), inductive sensors, capacitive sensors, ultra-sonic sensors, mechanical switches using an actuator and movable contact, and others. In the illustrated embodiment, the detector 64 may be a magnetic field detector, such as a linear Hall Effect sensor, that is configured to detect a magnetic field of at least one magnet or other magnetic material 66*a*, 66*b* that is mounted in or to the cabinet 12. Referencing FIG. 2, in the illustrated embodiment, the cabinet 12, includes a first magnet 66*a* and a second magnet 66*b* that are positioned below the game board 22. The magnets 66*a*, 66*b* be positioned in a variety of different locations, including, for example, above or to the sides of the game board 22, among others. According to certain embodiments, the magnets 66*a*, 66*b*, may be inserted into holes in bosses 67*a*, 67*b* formed in the cabinet 12. The first and second magnets 66*a*, 66*b* may have opposite orientations so that magnets 66*a*, 66*b* have opposite polarities facing the game board 22. The magnetic field detector is used to detect the polarities of the portion of the magnets 66*a*, 66*b* that is facing the game board 22. This detected polarity is then used by the peripheral game controller 65 to determine the orientation of the game board 22, such as whether the game board 22 is in the first or second position. By knowing the position of the game board 22, the peripheral game controller 65 may determine which game is being played. Moreover, the peripheral game controller 65 may then be able to know whether signals from the game board 22 indicative of game play are part of the current game play or are to be ignored.

When the game board 22 is at the first position, the magnetic field detector is in relative close proximity to the first magnet 66*a*. The magnetic field detector may then be able to detect the polarity of the portion of the first magnet 66*a* that is facing the magnetic field detector. For example, the first magnet 66*a* may be oriented such that the north magnetic pole of the magnet 66*a* is facing toward the magnetic field detector, while the south magnetic pole of the magnet 66*a* is facing away from the magnetic field detector. With the first magnet 66*a* in this orientation, the magnetic field detector may detect the north polarity of the first magnet 66*a*.

Conversely, when in the game board 22 is moved to the second position in the illustrated embodiment, the magnetic field detector may be in proximity to a second magnet 66*b*. The second magnet 66*b* may have an orientation that is opposite of that of the first magnet 66*a*, such as having the south polarity facing the magnetic field detector. Therefore, the magnetic field detector may detect the south polarity of the second magnet 66*b* when the game board 22 is in the second position. Thus, the detection of a north or south polarity may be used to indicate whether the game board 22 is in the first or second position.

Figure 8:
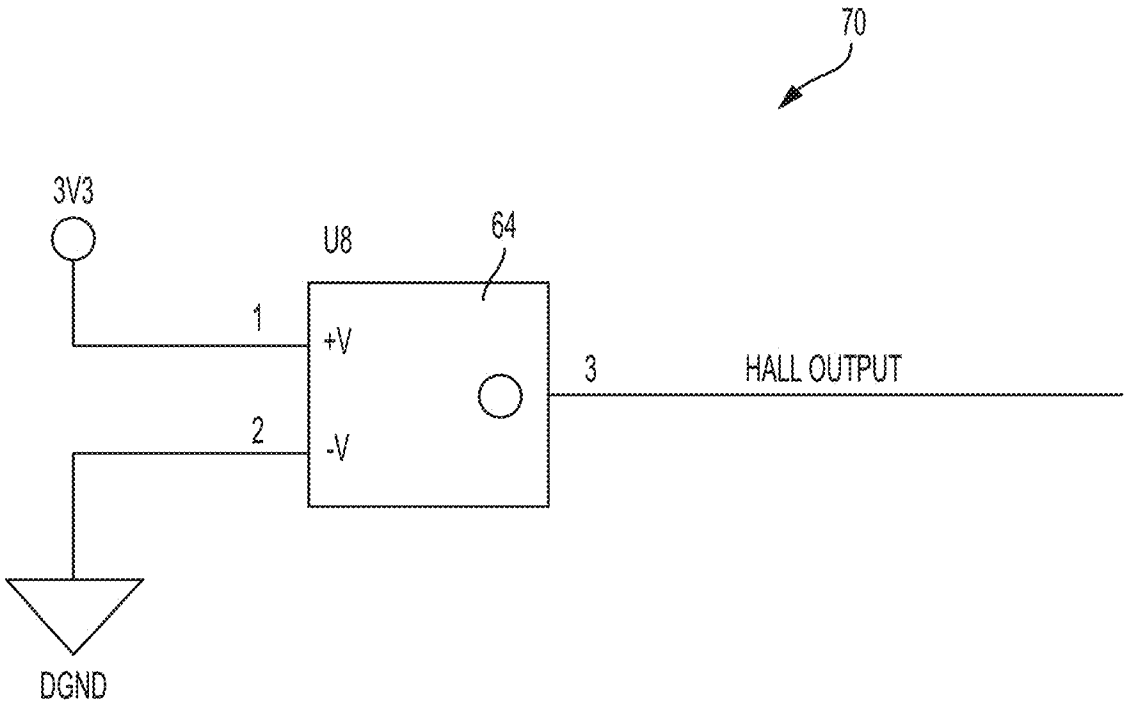
FIG. 8 is the schematic of the circuitry for a magnetic field detector according to an illustrated embodiment of the present invention.

FIG. 8 is a schematic of the circuitry of a magnetic field detector 70 according to an illustrated embodiment. As shown, the magnetic field detector is powered by a supply voltage (3V3) while also being connected to a ground (DGND). The actual supply voltage used to power magnetic field detector may vary depending of the type of magnetic field detector circuit that is used as the detector 64. The magnetic field detector is also shown as outputting a voltage, which, in this example, is referenced by "HALL OUTPUT". The voltage outputted by the magnetic field detector may vary depending on the magnetic fields detected by the magnetic field detector 70. This outputted voltage may then be used by the peripheral game controller 65 to determine which target of the game board 22 is oriented for game play by the player, as discussed below.

Figure 9:
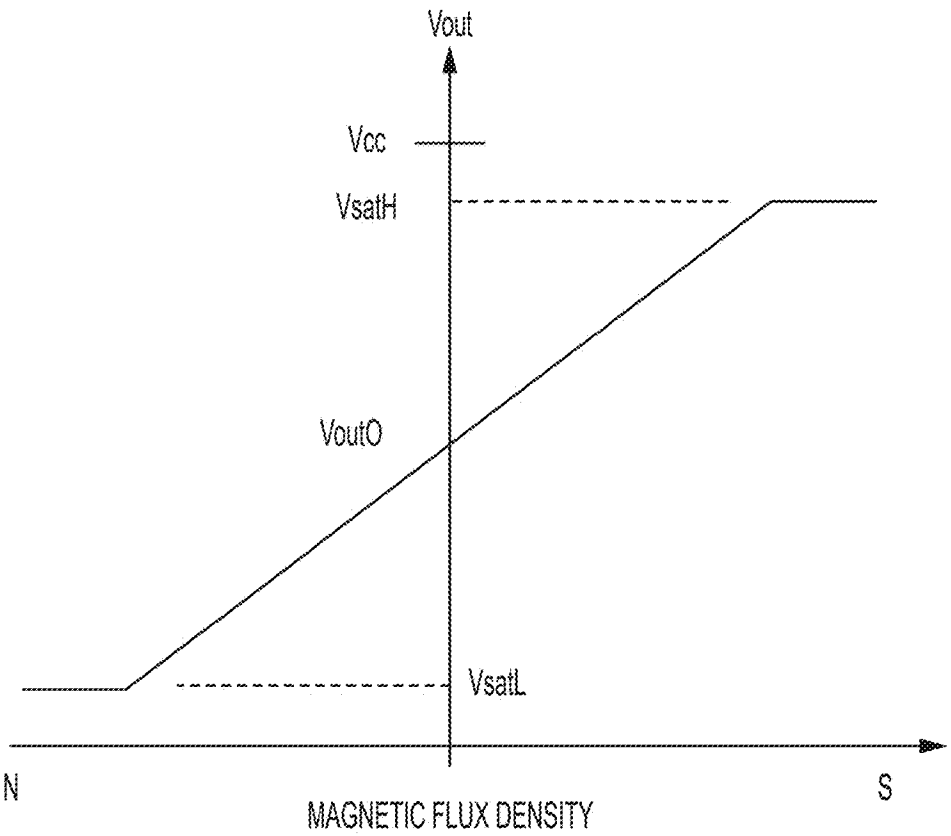
FIG. 9 illustrates exemplary trip points for the magnetic field detector according to an illustrated embodiment of the present invention.

FIG. 9 illustrates the use of outputted voltage (VoutO) from a magnetic field detector that is linear Hall Effect sensor, with "N" and "S" representing detected north and south polarities, respectively, Vout indicating the output voltage range of the magnetic field detector, and Vcc indicating a supply voltage necessary to operate electronics. Referencing the left side of FIG. 9, in the illustrated embodiment, when the magnetic field detector detects a magnetic flux density that has a primarily north polarity, the VoutO level is at a low level saturated voltage (VsatL). Conversely, referencing the right side of FIG. 9, when the magnetic field detector detects a magnetic flux density that has a primarily south polarity, the VoutO level is at a high level saturated voltage (VsatH). Further, as shown, the VoutO level may vary between the VsatL and VsatH levels based on the degree that the magnetic field detector detects north and/or south polarities. For example, when the game board 22 is in a latched at a first position, the magnetic field detector may be in close proximity to the north magnetic pole of the first magnet 66*a*. At this position, the VoutO level may be at a VsatL level. As the game board 22 is rotated toward the second position, and the magnetic field detector is being moved away from the first magnet 66*a*, the VoutO level may change, such as increase, as shown in FIG. 9. As the game board 22 continues to be rotated, the VoutO may reach an indeterminate level or range between VsatL and VsatH, which may indicate that the game board has been rotated to a position somewhere between the first and second positions. The VoutO level may continue to increase as the magnetic field detector comes into closer proximity to the south magnetic pole of the second magnet 66*b* and may reach the VsatH level when the game board 22 is latched at, or in proximity to being at, the second position. Such non-binary ability to detect the relative orientation of the game board 22 relative to the cabinet 12 of the gaming machine 10 may also be useful in automatically controlling and adjusting the orientation of the game board 22 relative to the machine 10, as will be described below.

The VoutO level may be monitored by the game controller, for example, the peripheral game controller 65, to determine the position of the game board 22. In such an embodiment, the VoutO level may be used by the peripheral game controller 65 to determine which target side 24, 26 of the game board 22 to monitor for purposes of game play events, including, detection of scoring on the target side 24, 26 presently positioned for game play relative to the game cabinet 12, and knowing which target side is facing outwards and, thus, knowing when a change in target side is required during a game. For example, an indication that the VoutO level is at or within a predetermined range of the VsatL level may indicate to the peripheral game controller 65 that the game board 22 is at the first position, where the first target side 24 is in the first or forward facing position relative to the cabinet 12. The peripheral game controller 65 may then monitor game play on the first target side 24 of the game board 22, such, for example, detecting a scoring or non-scoring, events during game play of the first target side 24.

The VoutO level may also indicate to the peripheral game controller 65 which target side 24, 26 is not being played, such as which target side 24, 26 is currently in the second or rearward facing position relative to the cabinet 12 so as to prevent the award or allocation of points or prizes due to scoring on the rearward facing target side 24, 26. According to certain embodiments, the peripheral game controller 65 may deactivate the rearward facing target side 24, 26, such as, for example, by stopping the delivery of electricity needed for game play of the rearward facing target side 24, 26 and/or deactivating detection of scoring or non-scoring events on the rearward facing target side 24, 26. Such deactivation may prevent inadvertent or improper scoring or non-scoring activity when the opposite, forward facing target side 24, 26 is being played. Further, the peripheral game controller 65 may similarly deactivate both target sides 24, 26 when the indeterminate VoutO level indicates to the peripheral game controller 65 that the position of the game board 22 is being changed. Such deactivation while the position of the game board is being changed may prevent the peripheral game controller 65 from erroneously detecting a scoring or non-scoring game play event due to contact with a target side 24, 26 during rotation of the game board 22 by a player.

According to certain embodiments, the latch mechanism 36 may include a sensor that is used to provide a signal to the peripheral game controller 65 that indicates when the game board 22 is going to be rotated so that contact with the target side 24, 26 is not interpreted by the peripheral game controller 65 as a scoring or non-scoring game play event. For example, the latch mechanism 36 may include a capacitive sensor that senses when a player contacts the handle 38. A signal may then been provided to the peripheral game controller 65 that indicates that the player is in contact with the handle 38 and that the peripheral game controller 65 should at least temporarily suspend detection of scoring and non-scoring game play events.

Figure 10:
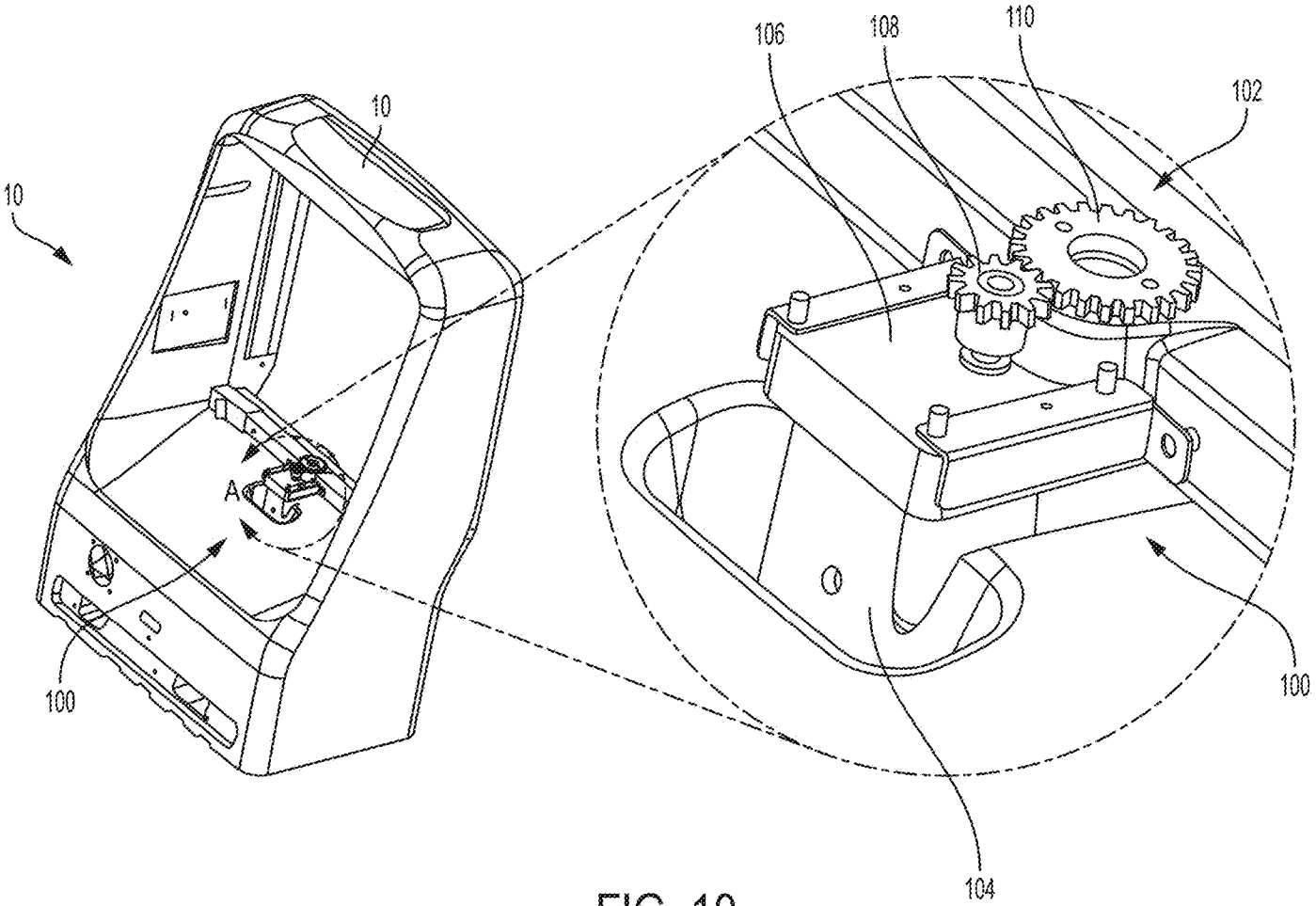
FIG. 10 illustrates an upper cabinet view of an embodiment including an integrated motor.
Figure 11:
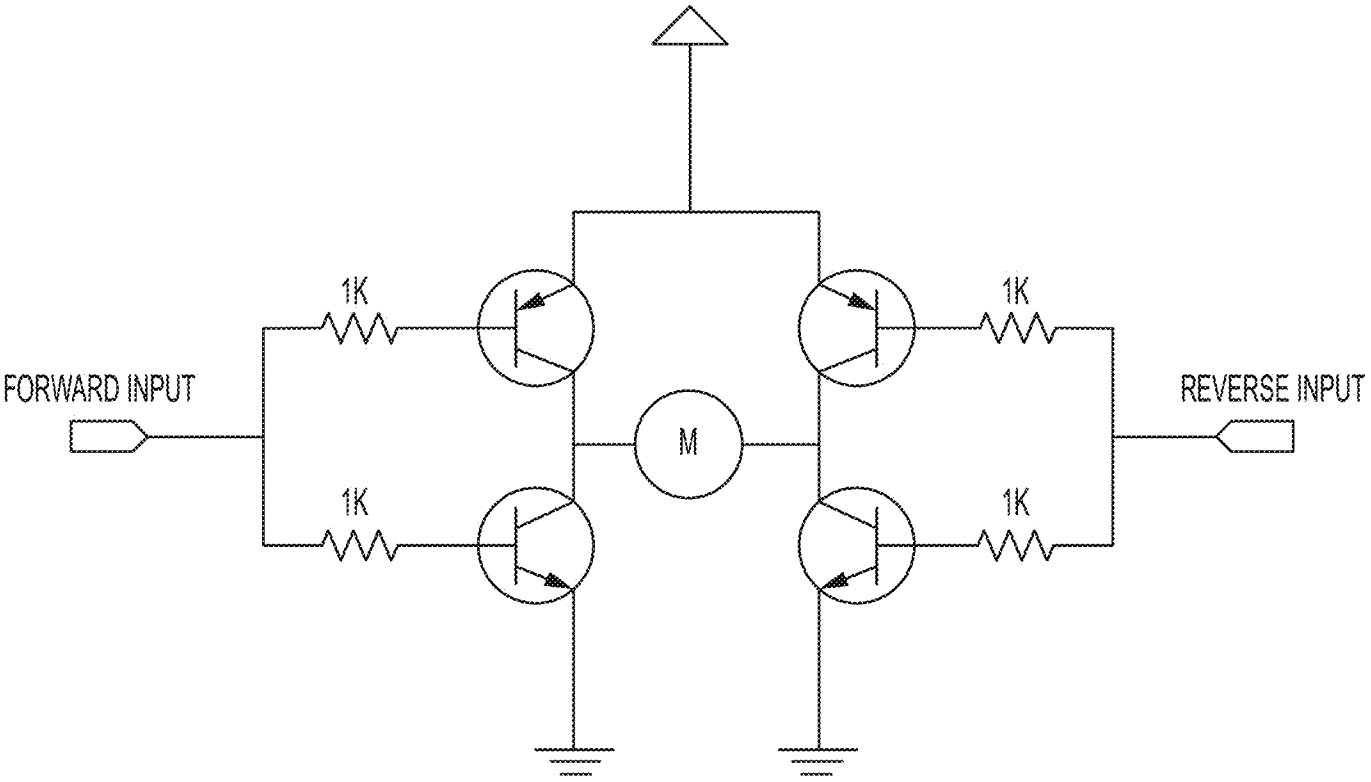
FIG. 11 is a schematic showing a possible electronic motor controller H-Bridge.

FIG. 10 illustrates an upper cabinet view of an embodiment including an integrated motor 100 with a close up of a gear arrangement 102 where diddle functionality can further be automated by having the game controller, or an associated controller, direct the motor to move the designated target into and out of place as needed. In FIG. 10, the upper cabinet 10 of the machine 10 is shown with the target assembly 16 removed to reveal the internal components. An enlarged detail view of the integrated motor 100 is shown on the right side of the figure. The integrated motor 100 in the illustrated embodiment includes an electrical actuator 104 having a gear reducing transmission 106 that includes a pinion 108. The pinion 108 is meshed with a drive gear 110, which engages a corresponding gear (not shown) on the axle supporting the reversible game board 22 such that, when the motor operates in one direction or another, the various target sides 24, 26 can be oriented selectively towards the front of the game machine 10. The motor may operate using any known electronic arrangement such as an H-Bridge for automatically moving the target assembly as needed, as shown in FIG. 11, where forward and reverse inputs can be provided by the game controller to activate the motor in one direction or another.

Figure 12:
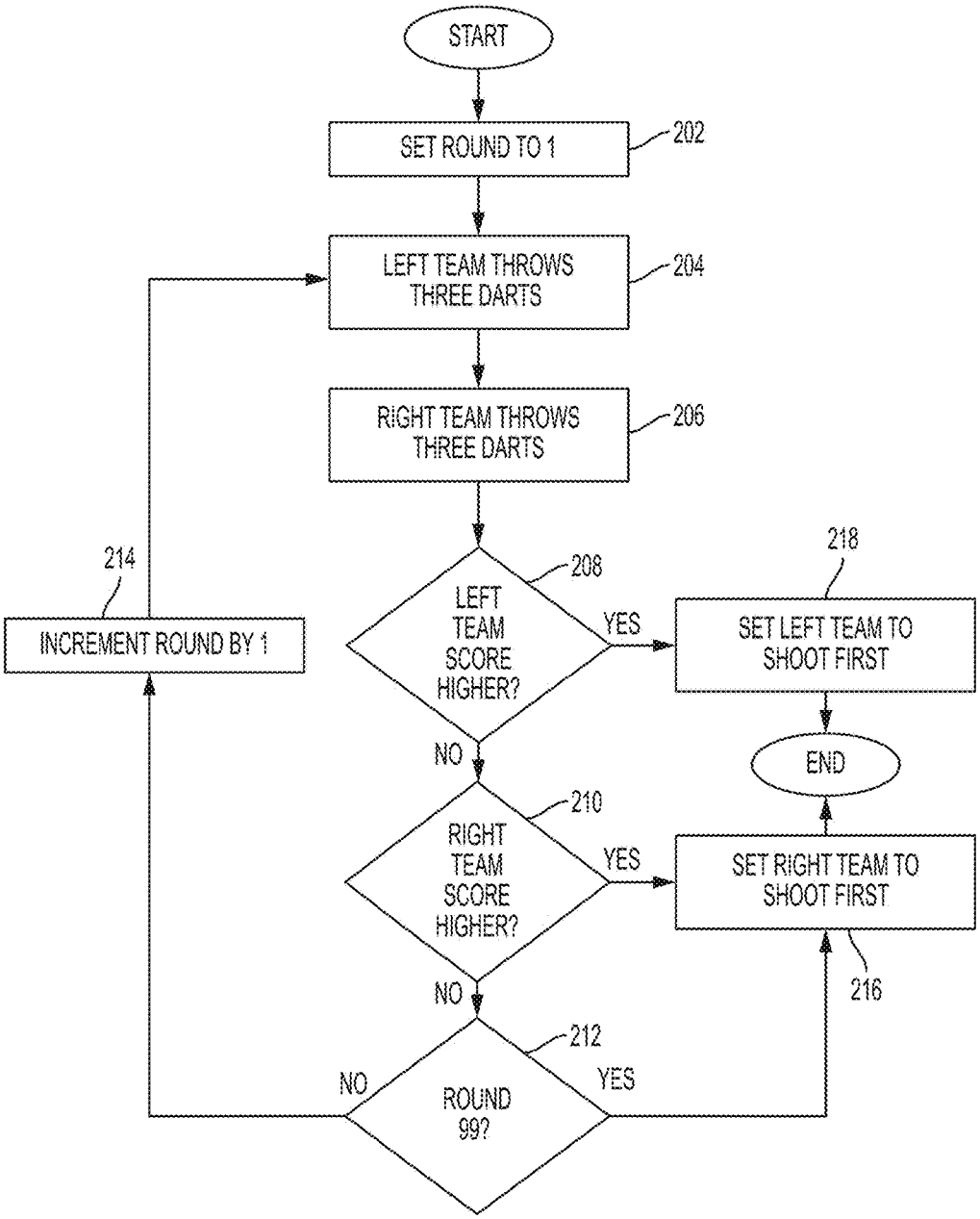
FIG. 12 is a flowchart showing the diddle process.

FIG. 12 is a flowchart for a method of play on an electronic gaming machine having a diddle functionality in accordance with the disclosure. The illustrated method can be carried out in the form of computer executable instructions implemented in hardware and/or software operating or present in the game controller. In accordance with the method, which can be carried in any order of steps, the game controller sets a game round variable to "1" at 202, which indicates that a round of play is beginning, for example, between two teams, which are referred to as the "left team" and the "right team" herein for sake of discussion. At 204, the first or "left team" throws darts, for example, three darts, and the game controller calculates their score. The throwing of darts at 204 may be carried out with a selected one of multiple target sides of the machine facing outwardly, which are preselected by the game controller and placed in a playing position of the game machine either manually or automatically.

The second or "right team" throws their darts at 206 on the same or a different target side of the game board at 22, and the game controller records the score. The game controller then compares the scores of the left and right time. When the game controller determines that the left team has a higher score than the right team at 208, the main game continues with the left team shooting first at 218. Similarly, when the right team is determined to have the higher score at 210, the main game commences with the right team shooting first at 216. For the main game, the game controller may keep the same target side or switch target sides on the machine, either manually or automatically, as previously described. If the first round ends in a tie, and while the game round variable count is less than 99 at 212, the round is incremented by one round at 214 and the diddle is repeated beginning with the first team throwing darts at 204.

Figure 13:
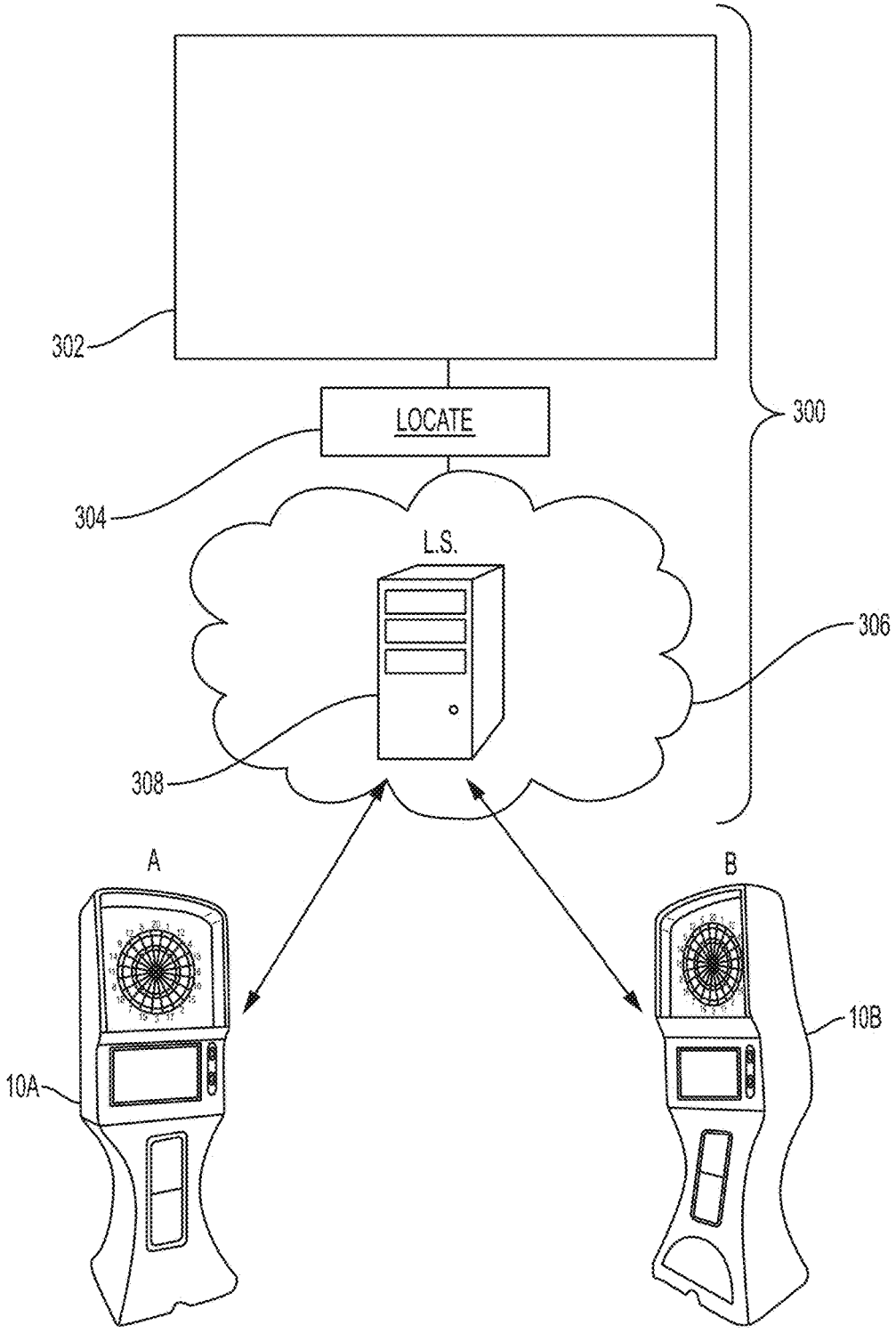
FIG. 13 depicts two remote dartboard machines for players competing.

FIG. 13 depicts a game lobby 300, which can be used by two remotely located dartboard machines 10A and 10B, or players, to locate each other in the game lobby 300. The game lobby 300 includes a gameplay controller or server 302 that may communicate with an optional sub-controller 304, which may act as a regional controller to select a lobby server 308 that will manage a particular game or match between the two machines 10A and 10B. The various servers and machines may communicate using any appropriate method. As shown, the gameplay controller 300, which may be integrated with the optional server 302 and the lobby server 308, may communicate with the machines 10A and 10B via an Internet connection and/or in a cloud computing framework 306.

Figure 14:
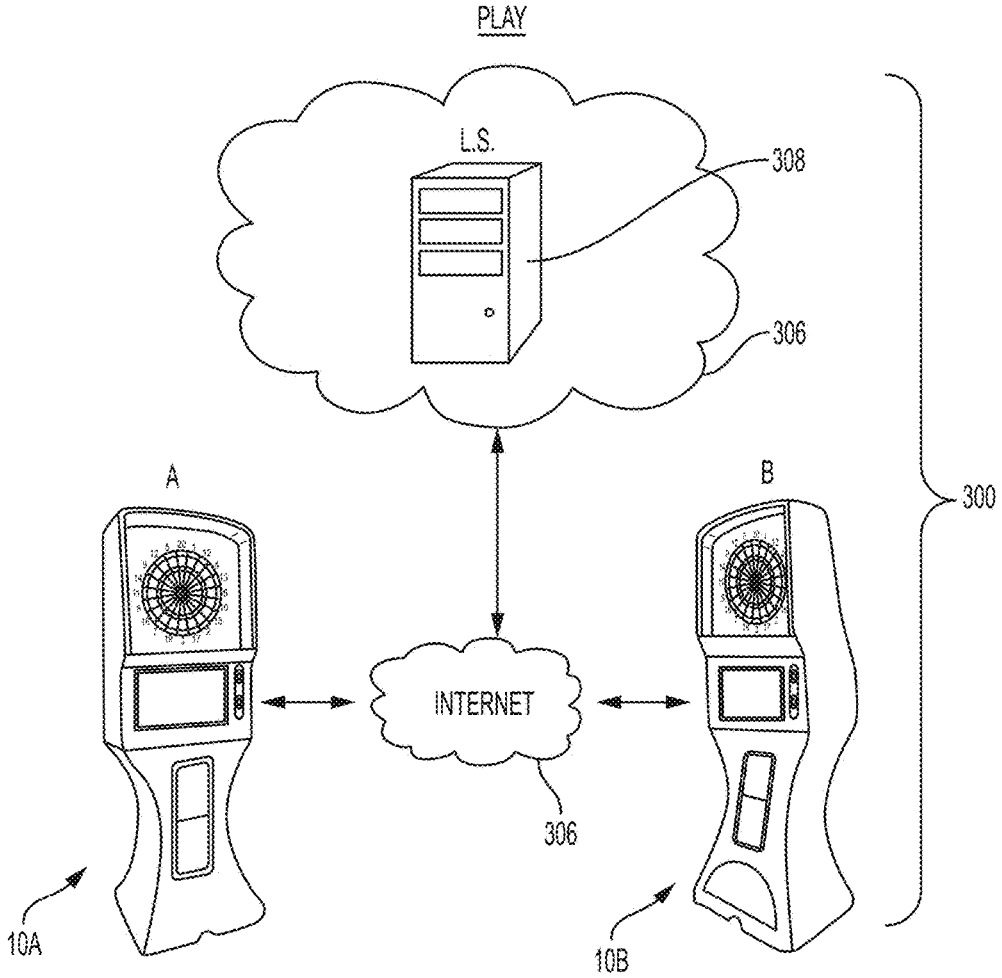
FIG. 14 depicts machines no longer needing the lobby server for game play via peer to peer.
Figure 15:
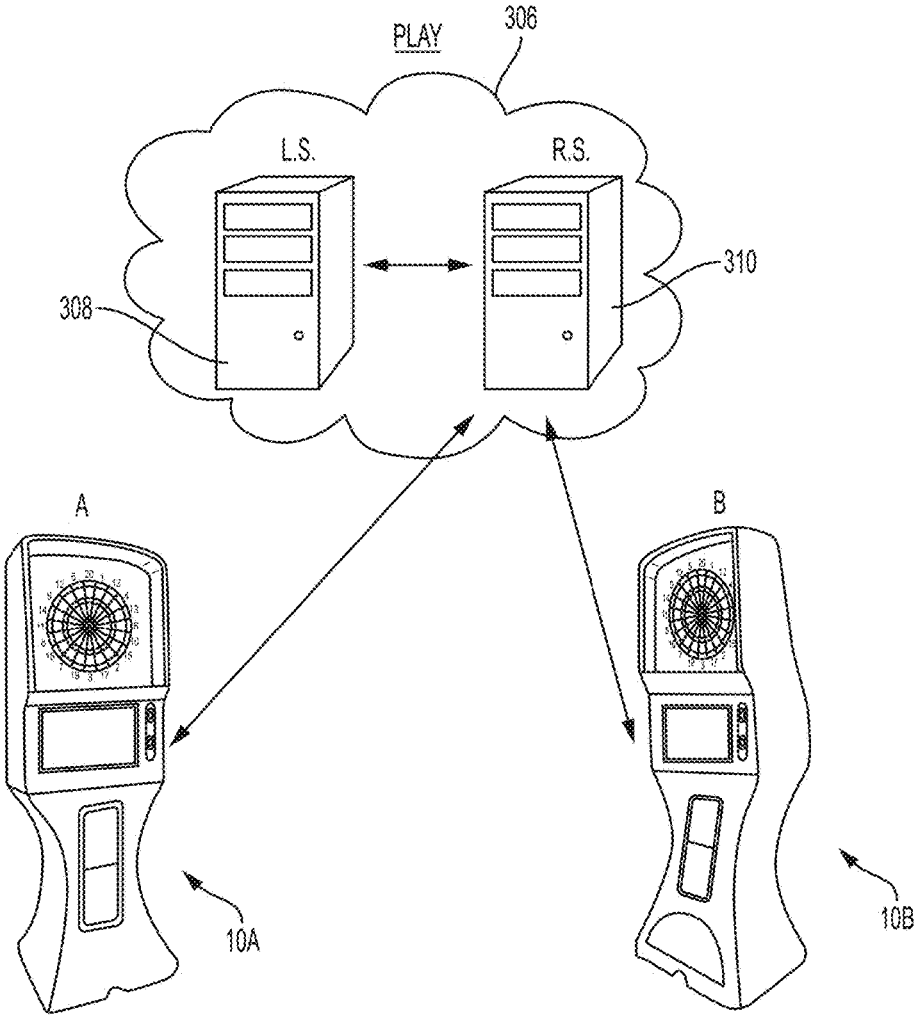
FIG. 15 shows dartboard machines playing each other through a separate relay server.

In one embodiment, once a game or match has been established, communication may continue between the two machines 10A and 10B directly. Such an embodiment is shown in FIG. 14, where players having progressed to actually playing with each other have the machines 10A and 10B they are playing on communicate directly and independently via the Internet 306 independently from the lobby server 308, because game play proceeds peer to peer, or, with the machines directly communicating with one another. In a variation of this embodiment, the machines may continue playing each other through a separate relay server 310 in situations warranting easier setup, such as in a tournament environment where dozens of machines may be operating in the same location and at the same time.

Figure 16:
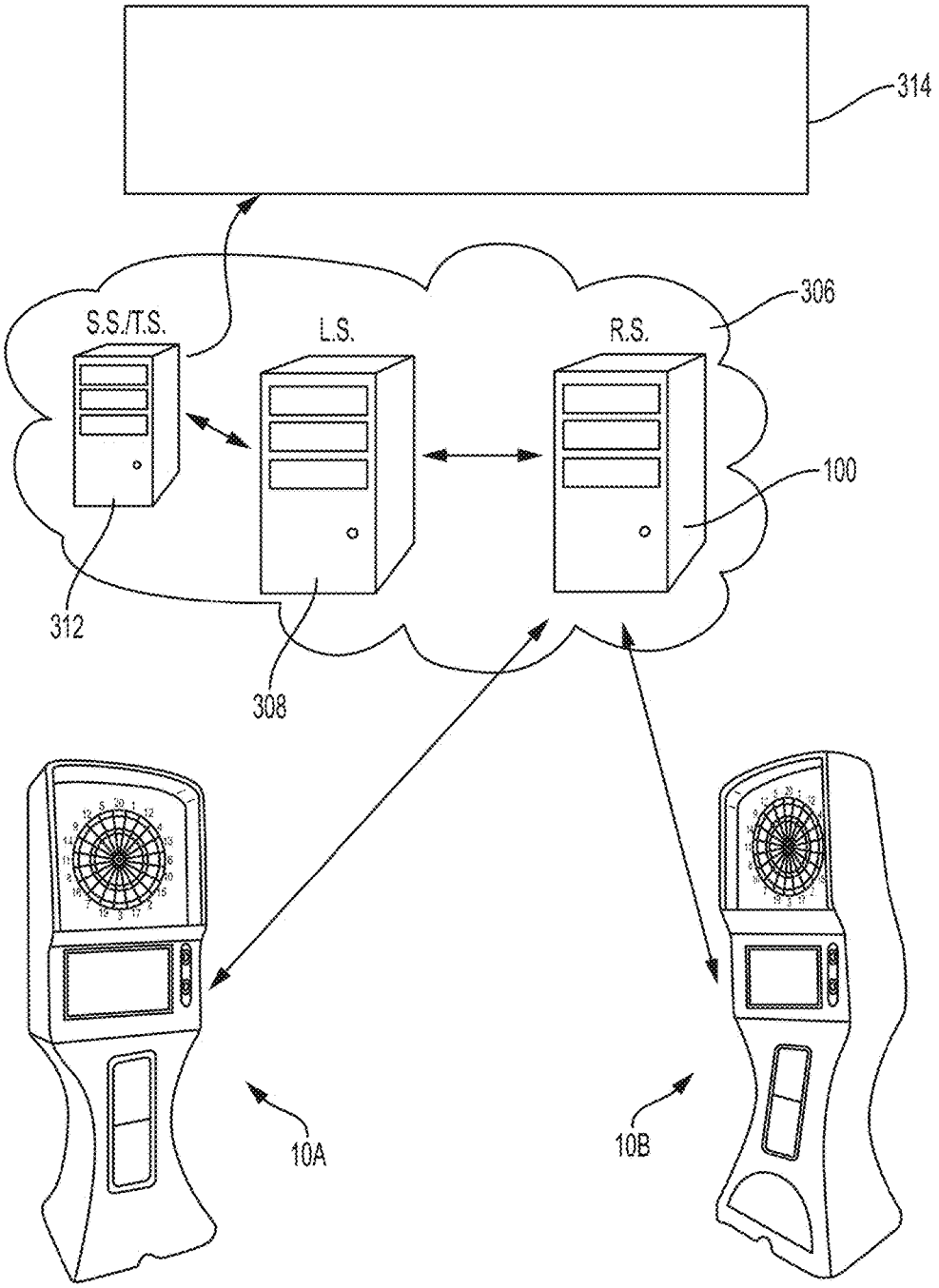
FIG. 16 depicts remote game play between participants on dartboards engaged in a tournament mode.
Figure 17D:
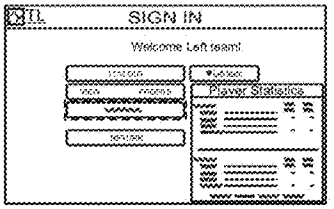
FIG. 17 Shows screen shots of player instructions indicating when to switch between targets.
Figure 17C:
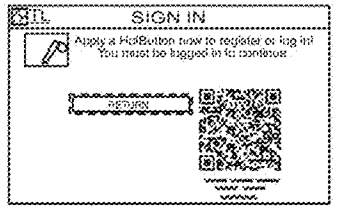
Figure 17B:
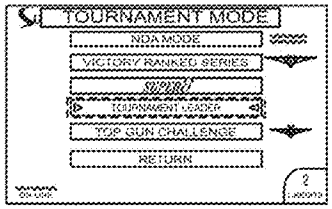
Figure 17A:
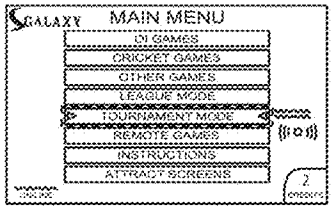
Figure 17H:
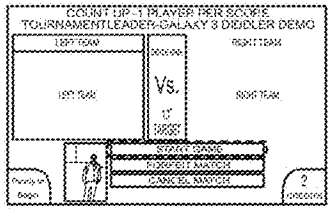
Figure 17G:
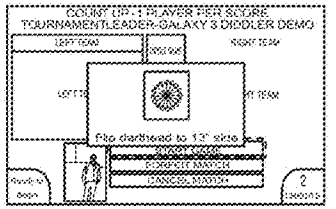
Figure 17F:
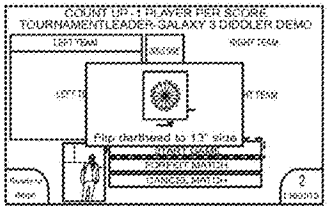
Figure 17E:
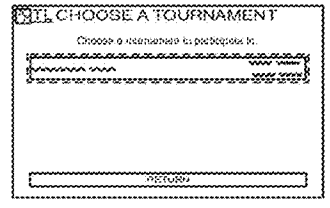
Figure 17L:
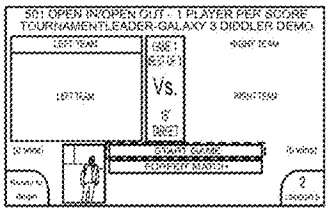
Figure 17K:
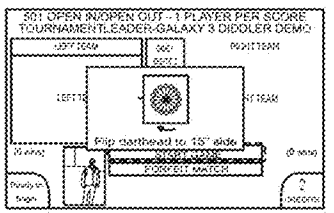
Figure 17J:
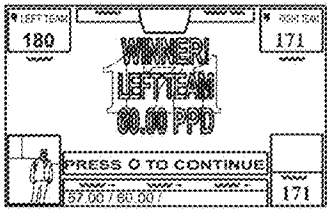
Figure 17I:
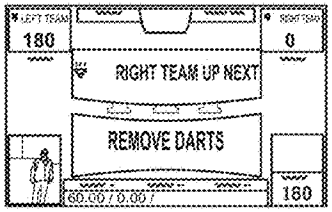

FIG. 16 depicts remote game play between participants on machines 10A and 10B, which are engaged in a tournament mode where player machines iteratively determine who their next opponent is via the lobby server 308 after match results have been communicated to a stats server 312, which is in charge of and operates to rank and track teams and scores, and the bracket 314 has been updated by a tournament server application operating in the stats server 312. Information about gameplay is relayed in two directions between the stats server 312, the lobby server 308 and the relay server 310, which directly communicates with the machines 10A and 10B.

FIG. 17 shows various possible screen shots with player instructions indicating when to switch between targets for the diddling step in, for example, a remote tournament competition. At "a," the tournament mode menu is chosen; at "b," the remote tournament option is selected; at "c" and "d" players sign in to register their attendance and participation in available events to be displayed for their navigating choice at "e." Once signed into the available tournament, "f" and "g" show dartboard displayed instructions indicating that the diddle step must occur by switching the target to the 13 inch side. Screens "h" through "j" show that 'Left Team' wins the diddle step, and "k" and "l" show that 'Left Team' goes first in the actual first game of the match, 501 O/O, by being located in the first slot to the left of the 'Vs.' designation for 'Left Team Vs. Right Team.

Figure 18:
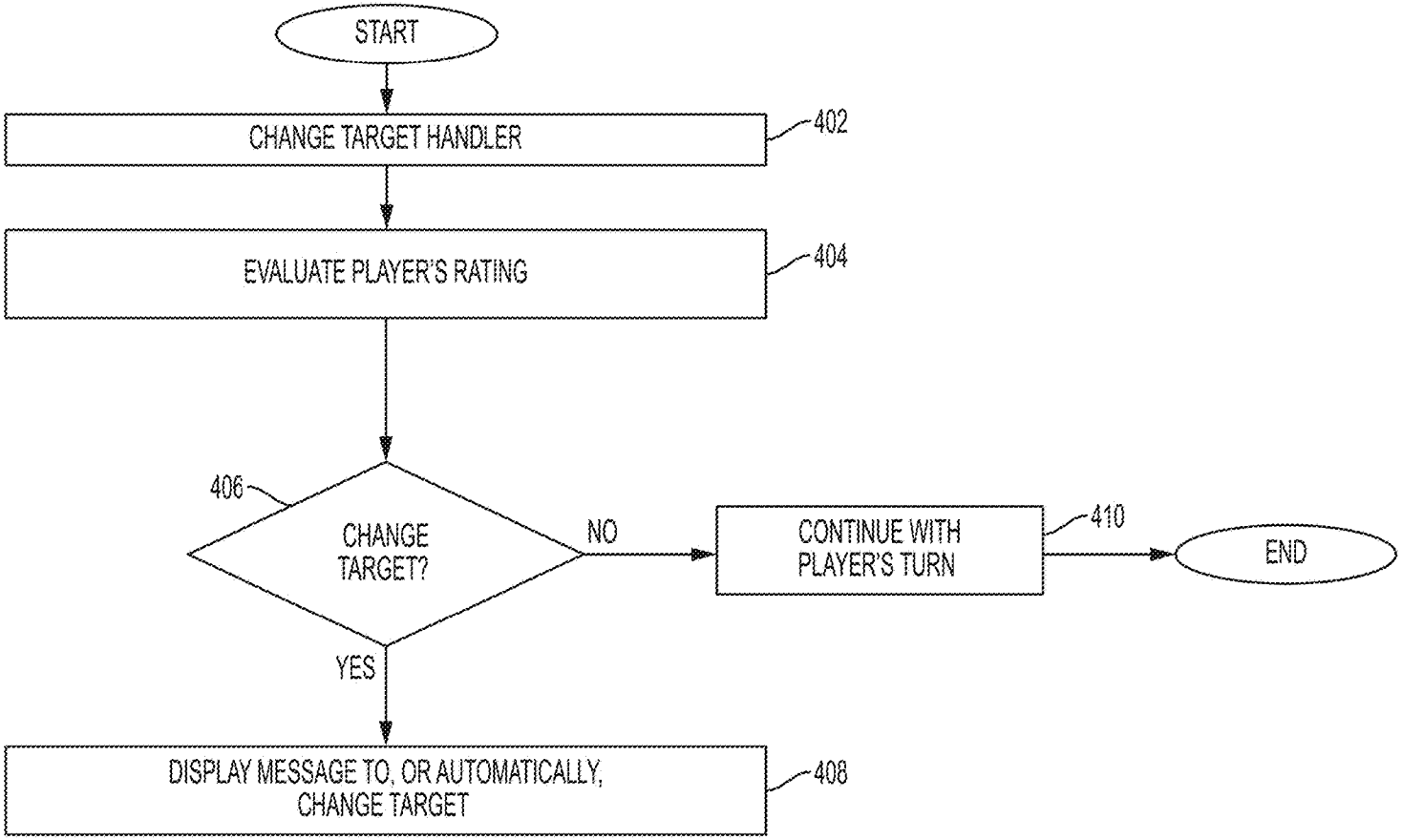
FIG. 18 is a flowchart of the possible operation of the handicap factoring into whether or not the target needs to be changed based on a player's skill level.

In certain game circumstances, the machine can provide a handicap to one player when players of unmatched skills are paired for a game. FIG. 18 is a flowchart for a method of providing a handicap to one player. In accordance with the method, operation of the handicap factoring into whether or not the target needs to be changed based on a player's skill level is carried out by the game controller of the machine, or is alternatively carried out at the level of the game lobby 300 for remote players. Whether a handicap is used or not can be an option selected by the players. When a handicap is present, one player is presented with a larger target, and the other player, the more skilled player, is presented with a smaller target. Both the larger and the smaller targets may be present as different gaming pads or targets on the same game pad assembly of the machine, which can be presented towards the front of the machine for play either manually or automatically as previously described.

In accordance with the method shown in FIG. 18, a target handler operation determines whether a handicap is to be applied at 402. Based on various parameters such as the player's ranking or historical scores, a user selection, tournament rules and the like, the controller evaluates the player's rating at 404 to determine whether a player requires a handicap. A decision at 406 to use a handicap at 408 causes the controller to determine the target pad in use and, if necessary, switch the target pads on the machine from one to another. If the player's handicap and target pad in play match, the game continues at 410 without changes to the target pad.

In accordance with one embodiment, similar to switching between different sized targets for computer determination of who goes first in an actual game through a diddling process, switching between targets can also be used for making games easier for less experienced or less skilled players and/or making games harder for advanced players through a novel method of handicapping which this also allows.

"Handicapping" describes the process of creating an environment where players of different abilities can engage in balanced competition. This is usually accomplished by making the competition more difficult for players with advanced skills or by making the competition easier for players with lesser abilities.

The amount of handicapping may be adjusted by combining various features of the invention as well as adjusting the degree of effect of the features. As used herein, the term "advanced player" refers to a highly skilled player. The term "beginner player" refers to a less skilled player.

Differences in player capabilities, for example, could be based on a method for calculating the relative skill levels of players in competitor-versus-competitor games, where the difference in the ratings between two players serves as a predictor of the outcome of a match similar to the widely known, so called, Elo rating in the dart gaming industry.

A player's Elo rating is represented by a number which increases or decreases depending on the outcome of games between rated players. After every game, the winning player takes points from the losing one. The difference between the ratings of the winner and loser determines the total number of points gained or lost after a game. In a series of games between a high-rated player and a low-rated player, the high-rated player is expected to score more wins. If the high-rated player wins, then only a few rating points will be taken from the low-rated player. However, if the lower rated player wins many rating points will be transferred. The lower rated player will also gain a few points from the higher rated player in the event of a draw. This means that this rating system is self correcting. A player whose rating is too low should, in the long run, do better than the rating system predicts, and thus gain rating points until the rating reflects their true playing strength.

Advanced players often throw more accurately than beginning players due to factors such as greater experience, control, and/or eye-hand coordination. Beginning players, especially children and elderly participants or players, may find it difficult to hit what they aim at, and as a result find it hard to compete with more advanced players. More experienced or more skilled players have a distinct advantage over less experienced or less skilled players. Oftentimes, less experienced or less skilled players lack the accuracy, consistency, and/or other skill to continuously hit what they aim at, especially the smaller target areas leading to the higher scoring opportunities.

Due to this, players of varying skill levels, such as beginners and advanced players, may have a difficult time competing against one another where each uses the same target at all times, whereas players of different ability levels may start and finish a game and have similar scores using the handicap approach described herein.

The handicapping method provided for competition between players provided by the method of FIG. 18, in the machine 10 and related game lobby functionality described above, is based on determining a desired difficulty level of a competition. Selection of the desired difficulty level allows for adjusting a difficulty level of a competition between players of sufficiently different skill levels by making the difficulty level more difficult for at least one player, easier for at least one player, or both. The difficulty adjustment is accomplished by selecting a target, either manually or automatically, based on the desired difficulty level to make the competition more difficult for at least one player, easier for at least one player, or both. Target selection by the game controller, or by user selection, is carried out based on a desired difficulty level. Thus, the rating can be used and adjusted before and/or during play to determine whether and when, if necessary, to transition between targets, and if doing so, to modify the input into succeeding rating updates.

The gaming system in accordance with the disclosure includes a target assembly incorporating multiple targets that can easily be selected for play, which selection allows players of differing skill sets, experiences and abilities to compete on a level playing field. This enables the beginning players to compete more evenly with advanced players who may be able to much more readily aim at, and hit their desired focus area on the dartboard target activated and properly positioned. These smaller segment areas may be very reasonable for an advanced player to aim at and hit, but many beginning players may struggle in doing so. By having a larger target that can be moved into and out of place to accommodate players as warranted, beginning players can have an easier time and more enjoyment when matched against those of more skill.

When used in combination, flipping between the different sized targets during game play between rounds may be used to further enhance any advantage a less skilled player may have because they are more likely to succeed at coming closer to the target area focused on, placing a beginning player on a more even playing field with an advanced player. The game may be designed to level the competition between players of different abilities. For example, it may include much shorter time frames on the larger target to minimize the size advantage of a more advanced player. For example, a game may include rounds where both a beginning player and an advanced player may each throw on the same sized target, but then be changeable from round to round, possibly even dart to dart, as necessary.

Player handicapping is important to ensure that opposing players in local, in-house, and/or remote dart leagues, tournaments and casual play are evenly matched in a way comparable to that of an advanced player, making a more even playing field between the players of different ability levels.

Accordingly, a handicapping scheme in accordance with the disclosure minimizes unfairness between players by configuring the game machine to decide on a selection of the target pad, either manually or automatically with a motor/gear mechanism, by effecting a transition between different target sensor sizes and/or types, based on player skill level.

While utilization of different sized targets is often sufficient to handicap a game, some embodiments may counteract this advantage between players of different ability levels by strictly using separate targets for players of different ability levels, and may include, and/or be combined with other commonly used handicapping approaches to further enhance competition between players of different skill levels, while at the same time providing utilization of commonly accepted approaches. Such other handicapping approaches may be used concomitantly as the basis for ascertaining optimal target transition times. For example, one game in a match may use both sized targets to accommodate players of different ability levels, while others may have each, the advanced players and beginners, shoot at the same sized target, to also use the more commonly accepted dart based or round based approach for that particular phase of the competition.

For example, in dart competitions, there are currently several methods of handicapping players, all of which are based upon player averages. The method depends upon the type of average used. Two types of averages are "points per dart" (hereafter, "PPD") and "marks per round" (hereafter, "MPR").

The PPD average is used in a variety of dart games, but primarily in '01 games, where a player begins with a first score (e.g., 301, 501, 701, 1001, etc.) and progresses downward to a second score (typically, zero) by hitting a dart board with darts. The game ends when a player reaches exactly the second score. In such games, a player normally throws three darts per turn. When a dart hits the board, a certain number of points are taken away from the player's score based upon which area of the target the dart lands. At the end of the game, the total number of points that a player has earned by hitting numbered areas is divided by the total number of darts that the player has thrown. The resulting number is the player's PPD average: Total Points Scored/Total Number of Darts Thrown.

The MPR average is typically used in Cricket games, where a player is required to hit certain targets on the dart board to score points. For example, the segments 15-20 on a dart board of a standard configuration, may be the designated scoring targets for marks. The first player to hit all of the required marks and who also has the highest point total wins the game. In such games, a player throws three darts each turn or round. The MPR average is calculated in two steps. First, the number of rounds played is calculated by taking the total number of darts thrown by the player and dividing by three (the number of darts per round). Next, the number of required marks that a player hit during the game is divided by the number of rounds. The resulting number is the player's MPR average: Total Marks Hit/(Total Darts Thrown/3).

The PPD car MPR averages can be calculated based on an individual game, a match (i.e., a series of games), or a player's lifetime history. All relevant parameters for a particular game, and also a particular player, may be stored in a database on a game server, as discussed above.

In some handicapping systems, players are divided into groups based on their PPD average, MPR average, or estimated skill level. Each group or level is assigned a certain number, usually from zero to six, which becomes the assignment of a "spot dart" handicap. When a player is assigned a spot dart handicap, the opponent is permitted to throw that number of darts to earn points or marks before the handicapped player gets a chance to throw any darts. For example, a scheme for assigning spot darts when using the PPD average may work as follows:

PPD=1-20 may result in 0 spot darts

PPD=21-40 may result in 1 spot dart

PPD=41-60 may result in 2 spot darts. In another spot dart scheme, the handicapped player must give the assigned number of darts to their opponent.

Other known handicapping schemes include "spot point" handicapping and "spot mark" handicapping. In these two methods, the handicapped player and the opposing player receive the same number of darts, but the goals that they need to achieve to win the game are different.

For example, when using spot point handicapping in the game of "301," the object of the game is for each player to take their score from 301 points to exactly zero points. If a player has a higher PPD average than his or her opponent, then the higher average player will need to earn the full 301 points to reach zero. However, when using the spot point handicapping feature, the opposing player will start the game with a lower score, such as 235, and thus only needs to earn 235 points to win the game. Alternatively, spot point handicapping may be used to "increase" the point total that the higher average player starts the game with (e.g., 350, instead of 301), while the lesser skilled player begins play at 301 points. Regardless of whether the better skilled player's score is increased or the lesser skilled player's score is decreased, the formula used to calculate spot points is selected so that if each player performs according to their average, both players would reach zero on the same dart throw number (e.g., on the 12th dart thrown, 14th dart thrown, etc.), Spot mark handicapping is used primarily with Cricket games, where a player needs to hit marks on specific targets. The player with the higher MPR average is required to hit all of the specified marks to win the game, whereas the player with the lower MPR average starts the game with marks already scored, and therefore does not need to hit all of the specified marks to win.

Actual handicapping establishment processing is conventional and thus is not described in further detail herein. Whatever the pre-established handicap process, the resulting ratings may be used readily with this invention to compute when transition between target sizes is warranted, where players can be notified to do so for game continuation manually, or the dartboard computer can initiate automatic target transition via an integrated motor/controller/gear mechanism if included with the dartboard. The particular type of handicap depends upon the type of dart game being played and depends upon the scheme selected by the league.

However, other schemes are within the scope of the disclosure. To further minimize any potential unfairness transitioning between targets can also be made gender specific, based upon skill differences between male and female players.

The present disclosure may also be used with a modification of the spot dart handicap scheme. In this scheme, the better player would have the number of darts that he or she can throw taken away automatically by the electronic dart board. The number of darts taken away would depend upon the skill level of the better player relative to the weaker player. The number of darts taken away would change for each game based on the floating average of the unranked player.

The present invention may also be used with other types of handicapping schemes, including player averages based upon "points per round" and "marks per dart." The present invention may be used in other types of games which use handicaps, and the scope of the invention includes the use of the rolling or floating handicap schemes.

While the invention has been described with reference to certain embodiments, it will be understood by those skilled in the art that various changes may be made and equivalents may be substituted without departing from the scope of the invention, and that, in addition, many modifications may be made to adapt a particular situation or material to the teachings of the invention without departing from its scope. Therefore, it is intended that the invention not be limited to the particular embodiment disclosed, but that the invention will include all embodiments falling within the scope and modifications could be made without departing from the broad inventive concepts of the invention.

The invention claimed is:

1. A gaming machine having a game controller, the gaming machine comprising:

a cabinet having a front portion and a back portion;

a game board rotatably secured to the cabinet, the game board having a first target side, a second target side, and a detector, the first target side being configured for game play of a first game, the second target side being configured for game play of a second game, the game board being rotatable about the cabinet between at least a first position and a second position, the first target side facing the front portion when the game board is in a first position and the second target side facing the front portion when the game board is in the second position, the detector being configured for the detection of a position of the game board relative to the cabinet, and the game controller configured to determine whether the game board is in the first or second position based on the position of the game board detected by the detector;

wherein the first and second target sides are electronic dart games, and wherein the game controller is configured to deactivate the second target side when the game board is in the first position;

wherein the game controller is configured to detect whether the game board is positioned at an indeterminate position between the first and second positions, the game controller being further configured to deactivate both the first and second target sides when the game board is determined to be in an indeterminate position; and wherein the game controller is programmed and configured to select one of the first and second positions for the game board for each of a first player and a second player, and also for each turn of each of the first and second players during a single game based on a handicap of the first or second player.

2. The gaming machine of claim 1, further comprising a latch mechanism operably connected to the game board and configured to engage the cabinet to releasably retain the game board in the first or second position.

3. The gaming machine of claim 1, further comprising an electric motor assembly connected to the cabinet and operably associated between the cabinet and the game board, the electric motor assembly operating to rotate the game board between the first and second positions based on command signals provided from the game controller, the command signals being indicative of the game controller's selection of one of the first and second positions for the game board based on a player's handicap.

4. The gaming system of claim 1, wherein the game controller is configured to access a database, the database containing historical information about the player's skill.

5. The gaming system of claim 4, wherein the database is present and stored on a game server that communicates with the game controller.

6. The gaming system of claim 5, further comprising a second gaming machine having a second game controller associated therewith and in communication with the game server, wherein the gaming machine is configured to interface with the first player and wherein the second gaming machine is configured to interface with the second player, and wherein the single game is played between the gaming machine and the second gaming machine.

7. The gaming system of claim 6, wherein the game controller and the second game controller communicate directly with one another at the exclusion of the game server when the single game is underway.

8. The gaming system of claim 6, wherein the game controller and the second game controller communicate to perform a diddle round to determine which of the first second player will play first in the single game.

9. The gaming system of claim 8, wherein the gaming and second gaming machines are each configured to perform the diddle round by collecting and comparing a score of each of the first and second players.

10. The gaming system of claim 4, wherein the player's handicap is a game parameter determined by the game controller based on the historical information about the player's skill stored in the database.

11. A method for deciding which one of at least two players will play first in a game of electronic darts played on a gaming machine, the method comprising:

providing a game controller in the gaming machine, the game controller configured to execute computer executable instructions;

in the game controller, execute computer executable instructions for setting a game round to a value of one;

execute computer executable instructions for adding a first score for a first player based on contact of at least one dart with a first target pad of the gaming machine, wherein adding the score includes sensing the contact of the at least one dart with a particular area of the first target pad;

execute computer executable instructions for adding a second score for a second player based on contact of at least one dart with the first target pad of the gaming machine, execute computer executable instructions for comparing the first and second scores to determine a winning score as between the first and second scores;

execute computer executable instructions for determining that the first player will play first and configuring the game machine for the first player when the first score is the winning score;

execute computer executable instructions for determining that the second player will play first and configuring the game machine for the second player when the second score is the winning score; and execute computer executable instructions for incrementing the game round value by one and repeating the adding the first score and adding the second score when the first, second and winning scores are equal.

12. The method of claim 11, further comprising executing computer executable instructions for rotating the first target pad from a first position, which presents a first target side to the first and second players, to a second position, which presents a second target side to the first and second players, when the second player has a handicap parameter associated with a gaming profile of the second player, the gaming profile of the second player being a parameter stored in a game server that is in communication with the game controller.

13. The method of claim 11, further comprising deactivating the second target side when the game board is in the first position.

14. The method of claim 13, further comprising executing computer executable instructions fur detecting whether the first target pad is positioned at an indeterminate position between the first and second positions, and deactivating both the first and second target sides when the first target pad is determined to be in an indeterminate position.

15. The method of claim 12, further comprising executing computer executable instructions for selecting one of the first and second positions for the first game pad for each of the first and second players and also for each of a plurality of turns of each of the first and second players during a single game based on the gaming profile.

16. The method of claim 12, further comprising releasably latching the first target pad to a cabinet of the gaming machine when the first target pad is in the first or second position.

17. The method of claim 12, latch mechanism operably connected to the game board and configured to engage the cabinet to releasably retain the game board in the first or second position.

18. The method of claim 17, further comprising executing computer executable instructions to provide a command signal to an electric motor assembly connected to the cabinet and operably associated between the cabinet and the first target pad, the electric motor assembly operating to rotate the first target pad between the first and second positions.

19. The method of claim 11, further comprising operating a second gaming machine, the second having a second game controller associated therewith and in communication with the game controller, wherein the gaming machine is configured to interface with the first player and wherein the second gaming machine is configured to interface with the second player.

20. The method of claim 19, further comprising establishing a connection for exchange of information directly between the gaming machine and the second gaming machine.

* * * * *